United States Patent [19]

Chesters

[11] Patent Number: 4,885,969

[45] Date of Patent: Dec. 12, 1989

[54] GRAPHIC MUSIC SYSTEM

[76] Inventor: Thomas P. Chesters, 1901 Marigold Ln., Hanover Park, Ill. 60103

[21] Appl. No.: 81,040

[22] Filed: Aug. 3, 1987

[51] Int. Cl.[4] ..... G10H 1/00; G10C 3/12

[52] U.S. Cl. ..... 84/1.01; 84/423 A; 84/478; 84/477 R; 84/DIG. 7

[58] Field of Search ..... 84/423 A, 423 B, 423 R, 84/DIG. 7, 425, 424, 477 R, 1.01, 470, 446, 479, 432, 478, 423, 428

[56] References Cited

U.S. PATENT DOCUMENTS

| | | | |
|---|---|---|---|
| 152,726 | 7/1874 | Cramer | 84/428 |
| 229,365 | 6/1880 | Black | 84/423 |
| 281,898 | 7/1883 | McChesney | 84/427 |
| 334,484 | 1/1886 | Stewart | 84/425 X |
| 722,998 | 3/1903 | Mahr | 84/425 |
| 1,009,194 | 11/1911 | Smith | 84/479 A X |
| 1,473,495 | 11/1923 | Miller | 84/428 |
| 2,221,143 | 11/1940 | Lang | 84/479 A X |
| 2,347,950 | 5/1944 | Huish | 84/479 A X |
| 3,022,698 | 2/1962 | Lucus | 84/423 A |
| 3,111,056 | 11/1963 | Weigl | 84/425 |
| 3,200,689 | 8/1965 | Rosberger | 84/423 |
| 3,209,637 | 10/1965 | Jewett | 84/425 |
| 3,392,620 | 7/1968 | Thompson | 84/423 A X |
| 3,926,088 | 12/1975 | Davis et al. | 84/477 R X |
| 3,943,811 | 3/1976 | Coles | 84/423 A X |
| 4,056,999 | 11/1977 | Bennett | 84/479 A |
| 4,227,436 | 10/1980 | Kryzanowsky | 84/423 A |
| 4,444,083 | 4/1984 | Apel et al. | 84/423 R |
| 4,480,519 | 11/1984 | Allen | 84/1.01 |
| 4,640,173 | 2/1987 | Coles | 84/1.01 |
| 4,750,399 | 6/1988 | Coles | 84/478 |

FOREIGN PATENT DOCUMENTS

| | | | |
|---|---|---|---|
| 3018406 | 11/1981 | Fed. Rep. of Germany | 84/423 A |

*Primary Examiner*—A. T. Grimley
*Assistant Examiner*—Matthew S. Smith

[57] ABSTRACT

An integral music system for use in association with all chromatically scaled musical instruments comprising an improved graphic keyboard design utilized in various mechanical, electric and over-keyboard embodiments, and a cooperative improved hexaline scoring method utilizing octave-designating noteforms, and a cooperative improved graphic referencing method utilizing color, symbol and tactual coding means. The improved graphic keyboard design has essentially coextensive alternately arranged, uniformly narrowed and widened keys. The improved hexaline scoring method has one or more six-line staffs which respectively utilize eight distinct noteforms to provide an eight-octave compass for each staff. The improved graphic referencing method has code formats which correlate the lines and spaces of the improved scoring method with the keying means of the various instruments. The invention additionally comprehends manual and computer assisted methods for converting existing music into the improved scoring format.

12 Claims, 8 Drawing Sheets

TG 1
TG 2
TG 3
SOL
I/O
V

PRIOR ART

GRAPHIC MUSIC SYSTEM

FIELD OF THE INVENTION

This invention relates to the Standard Music System and to the Uniform Music System, and more particularly to an improved music system which comprises an improved keyboard design with cooperative improved graphic scoring and referencing methods, and methods for the conversion of existing music into the improved scoring method of the improved music system.

PRIOR ART

Integral chromatic music systems such as the Standard Music System and the Uniform Music System may be generally considered to be formed from four basic elements being first, the physical design of the keying means of the various classes of musical instruments, such as keyboards and stringboards; second, the defined methods of recording musical notation, such as pitch variance and duration; third, the defined methods of referencing indicia between the written score and the instrument keying means, such as coloration and tactual identifiers; and fourth, the methods by which music existent prior to the development of a new or hybrid music system shall be converted into the newly derived format, such as by score conversion templates and charts which derive the new values from existing values. The present invention of a Graphic Music System, as a hybrid form of its prior art forms, must then address these four elements directly in order to provide a means whereby it may become in fact a truly integral music system equivelent in musical principle to both the Standard and the Uniform music systems, since to offer less would neither resolve the issues of the present invention of an integral music system nor justify the appearance of multiple intercooperative inventions within the context of a single patent application.

There has been a long standing unresolved need for a simplified holistic music system such as the present invention of the Graphic Music System which need has gone unfulfilled both because of the historical momentum of the Standard Music System and the inability of the Uniform Music System to overcome its own internal problems so as to become a simplified holistic music system, as will be explained forthwith. It will also be explained how the Standard Music System persists in its unreasonable approach to graphic relationships between score and instrument precisely because the Uniform Music System keyboarding method has never been sufficiently practical to warrant the practical development of a simplified Uniform method of scoring and referencing written music and the keying means of the various musical instruments. And logically, why without a practical score conversion method with which to provide Graphic music scores from previously written music, the Graphic Music System would not serve the very purpose for which is intended, which is to promulgate itself as an integral means by which both newly written and existing chromatic music may be perceived in a written graphic format immediately correlatable to the keying means of any chromatic musical instrument.

The physical design of the keying means of the various classes of musical instruments imposes a strict limit on how music is to be perceived as flowing from one semitone to another in the twelve semitone equal temperment, or chromatic music system, which fact is particularly evidenced by the physical design of the prior art keyboards. The Standard or traditional system utilizes a keyboard design which consists of seven wider, commonly white, lower case keys for the keying of natural whole tones, and five narrower and shorter, commonly black, upper case keys for the keying of accidental half-tones for each C octave of twelve semitones. The standard system then utilizes a five-line or pentaline scoring method wherein oval note symbols are displayed as natural or whole tone pitch increases when written in an ascending order upon the lines and in the spaces of the pentaline staff and ledger line system. Accidental tone positions are therein scored by placing sharping and flatting indicator symbols before a natural tone display. The only graphic relationship between the standard keyboard key array and its cooperative pentaline scoring method is in the fact that each natural tone lower case key generally represents either a line or a space position in the pentaline staff and ledger line system. However, this fact must be kept at a non-graphic level of interpretation because it is common to write pentaline music at one octave level and then further indicate that it is to be played out at a differing octave level, thus causing graphic conflict since the line and space order of notation in a pentaline staff system reverses sequentially per octave. Moreover, since each key signature in a pentaline system has its own sharping and flatting requirements, these must be borne in mind whenever playing music in key signatures other than C Major and A Minor. Similarly, the physical design of the standard keyboard being non-uniform requires that one memorize the various key signatures and chord patterns, which are then different for each key signature in terms of which upper and lower case keys are involved.

The Uniform or harmonic music system utilizes a keyboard design wherein six commonly white wider lower case keys are alternately arranged between six commonly black, narrower and shorter upper case keys per tonic octave of twelve semitones. Accidental tone keys are therein displayed along with natural tone keys in increments of one semitone per key. This then allows for the structuring of a six or seven line scoring method utilizing standard notational forms and ledger lines wherein each uniform keyboard key becomes either line-related as an upper case key, or space-related as a lower case key relative to the displayed pitch positions, or notes, on the lines and spaces of the scoring method. Although this method of scoring eliminates a need for accidental notation forms, the physical display of the notes requires a far greater overall distance per octave displayed when compared to the shorter scoring format of a pentaline staff system with its distance-saving accidental notation forms. Whereas a standard keyboard is commonly referenced in terms of the upper case key two-key and three-key repeating sub-sets, the uniform keyboard must be further referenced along its transverse length to indicate to the keyboardist precisely where certain tones fall in the uniform key pattern. How such referencing symbols shall be applied will depend upon how the given score is to be correlated to the physical tone-generating means of the particular keyboarded instrument involved. If the C tone is to be line-related in the score, then an upper case key must present the C tone. If the C tone is to be space-related in the score, then a lower case key must present the C tone. Thus if the C tone is line-related a seven-line or septiline scoring method is used, and if the C tone is space-related, a six-line or hexaline scoring method is used. In both methods the line and space order of tonal display on the keyboard is graphically equivelent to the line and space order of the written pitch notation so that the keyboard fingering positions and scored note positions are always graphically equivelent. Additionally, the uniform system requires that only two configurational sets of chord patterns be used as dependent on whether the tonic note is set on a line or in a space position. One serious disadvantage of the uniform system is that thus far all attempts to easily reference the aforementioned greater-sized uniform scoring method to the indiscernable tone positions of the uniform keyboard have failed to resolve the problem. Moreover, both the standard and uniform keyboard designs have the similar disadvantage of being physically structured so that the outstretched hand cannot easily nor comfortably finger chord patterns beginning and ending on the upper case keys. The addition of two extra standard-sized keys in octave lengths of the uniform keyboard makes finger penetration between adjacent upper case keys particularly awkward. Thus what appears to be needed to resolve the combined problems of both the standard and uniform music systems is a third hybrid music system wherein a uniform keyboard method is modified into a practical keying means, and wherein a uniform scoring method is modified into a briefer practical scoring format, and wherein a simplified referencing method is provided which will allow any chromatically scaled musical instrument to be cooperatively played in terms of existing music which has been converted into the modified score format.

The present invention of a unitive Graphic Music System thus contemplates an improved uniform keyboard design able to be alternately embodied as a mechanical keying or electric key-switching keyboard, or as an over-keyboard for existing standard keyboards, and further contemplates an improved hexaline scoring method which is graphically referencable to any chromatically scaled musical instrument by means of improved color, symbol and tactual referencing methods, and which utilizes various methods for the direct conversion of existing music into the specific musical format of the improved music system, thereby providing the unitive end result of an overall graphic music system able to act in lieu of both the standard and uniform music systems.

OBJECTS

One important object of the present invention of a Graphical Music System is the provision of a dramatically modified uniform keyboard design, termed the "graphic keyboard design," which is perceptually obvious as a line-related and space-related keying means. The improved keyboard design is physically achieved by considerably reducing the width of the standard keyboard-sized upper case keys of a uniform keyboard to approximately $\frac{1}{8}''$, and further altering said upper case keys by considerably elongating them so as to alter them from their common $3\frac{1}{2}''$ length to an average $5\frac{1}{2}''$–$6''$ length, thus making them essentially coextensive with their adjacent lower case keys; and then somewhat altering said lower case keys to make them uniformly wider than standard size at all points along their respective lengths at an approximate $\frac{7}{8}''$ uniform width. This arrangement of alternately disposed essentially coextensive uniformly narrowed upper case line-related keys, and uniformly widened lower case space-related keys then allows both key types to be equally accessible to the outstretched hand and fingers at all points along the respective key lengths from front to rear, and also allows for comfortable finger penetration onto any lower key surface. The improved graphic keyboard design may then be utilized in the form of a mechanical keyboard in lieu of a standard wooden keyboard, as for a piano; or in the form of an electric key-switching means, as in a music synthesizer; or in the form of an over-keyboard, slidably attachable and removable from a standard keyboard.

The mechanical keyboard embodiment of the graphic keyboard design of the invention has upper and lower case keys provided with endpieces which correspond to standard key actions, and the overall transverse length of the modified keyboard and the longitudinal length of the respective coextensive modified keys are of standard dimensions for a more simplified exchange with a standard keyboard key array. The various alternate forms of an electric keyswitching keyboard done in the manner of the invention utilize either standard keyboard controller means or flat touch sensitive membrane switching means to key various musical tone generator means. The mechanical removably attachable over-keyboard embodiment of the graphic keyboard design has provided a common hinge rod for its key array, which rod is set into a rigid frame able to be slidably positioned upon the top playing surface of a standard keyboard key array. Each respective over-key is then provided with mechanical linkage connective with a contact member affixed thereunder which is able to slidably pass through uniformly spaced guide slots in the bottom plate of the rigid frame, so that upon respective over-key depression the respective contact members will connectively move through the respective guide slots to further depress the standard keyboard keys positioned thereunder, thereby converting the standard key array into the improved graphic design of the invention.

Another important object of the invention is the provision of an improved hexaline scoring method which eliminates the use of both accidental notation and ledger line notation. The improved scoring method consists of one or more six-line staffs or "stacks" which respectively utilize eight distinct octave-designating noteforms to allow the indication of an eight-octave compass on the C through B note positions of the respective stacks. Usually two stacks are presented to provide an upper four octave and lower four octave, or treble and bass effect with a widened space between the two stacks being utilized for further notational symbols and lyrics.

A further important object of the invention is the provision of graphic referencing indicia for cooperative use between the graphic keyboard design or other musical instruments and the improved hexaline scoring method. The graphic referencing means consists of various color, symbol and tactual raised symbol coding means applied to the lines and spaces of the improved hexaline scoring method, and equivelently applied by suitable marking means or by label or chart means to the graphic keyboard design and to the keying means of other musical instruments to thereby clarify the specific graphic correspondence between the improved hexaline scoring means and the musical instrumentation. In use, the musician reads the referenced graphic format of the improved hexaline score in terms of the octavedesignating noteforms as relative markers for fingering positions on the referenced instrumentation.

Another object of the invention is the provision of various manual and computer assisted score conversion methods which allow the direct conversion of standard music into the format of the improved scoring method. The manual method employs a transparent plastic template for numerically gauging standard note positions relative to middle-C and utilizes this data in conjunction with a graphical chart-table which inputs the template numerical data and outputs musically equivelent data in terms of the improved scoring format as octave-designated noteforms in a proper relative C through B note stack position. Similarly, the computer assisted methods in varying degrees of automation process the input data of standard note positions and durational values and outputs their musical equivelents in terms of the improved scoring format.

Further objects and advantages of the present invention will become apparent from a consideration of the drawings and ensuing description thereof.

DESCRIPTION AND OPERATION OF GRAPHIC MUSIC SYSTEM

DESCRIPTION AND OPERATION OF GRAPHIC KEYBOARD DESIGN

DESCRIPTION AND OPERATION OF MECHANICAL GRAPHIC KEYBOARD

Figures 1A, 1B, 2, 3, 4A, 4B, 5, 6:
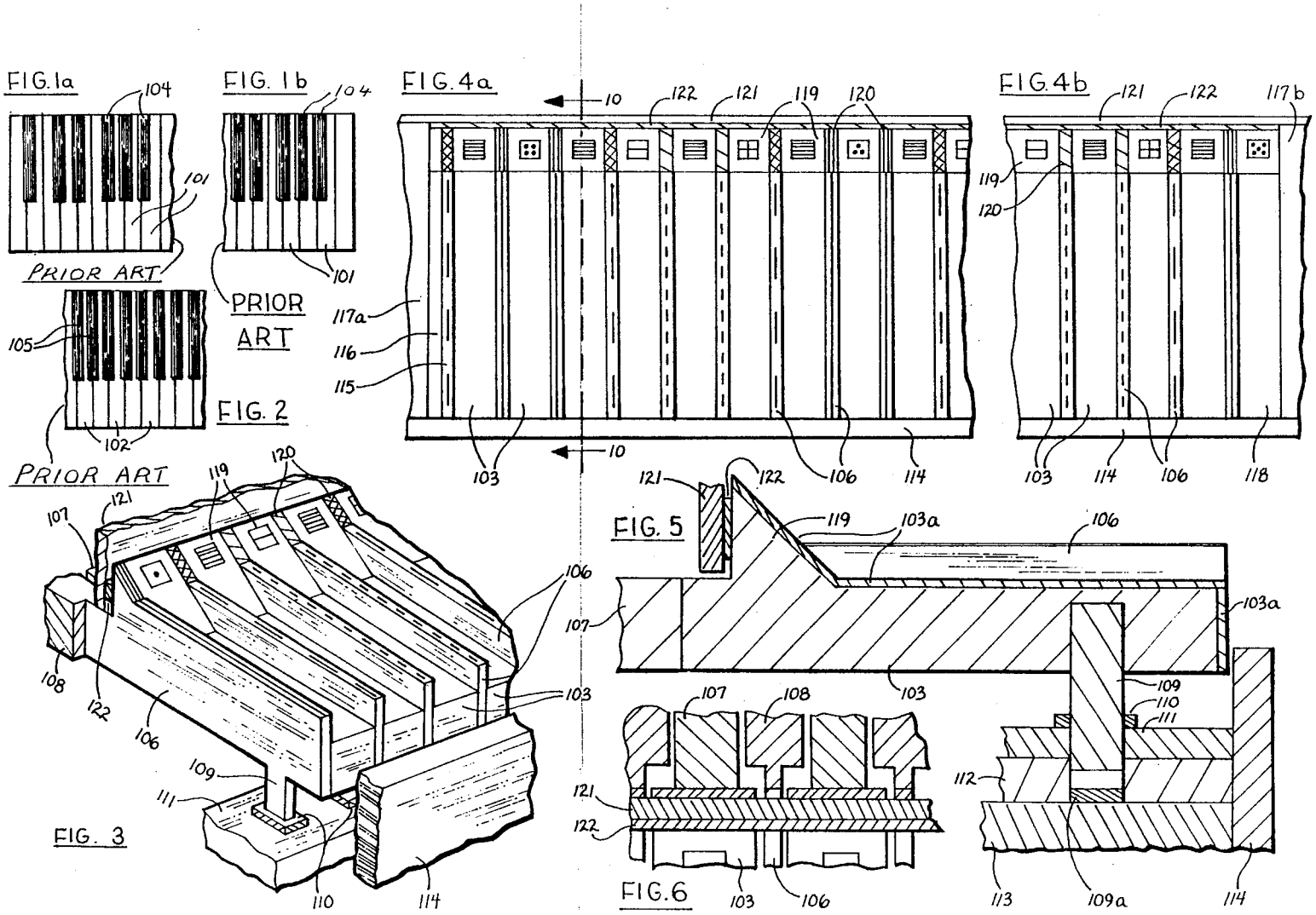
FIG. 1a PRIOR ART
FIG. 1b PRIOR ART
FIG. 2 PRIOR ART
FIGS. 1*a* and 1*b* respectively show the extreme left and right portions of the prior art form of a standard 1 ½ octave keyboard in top plan view.
FIG. 2 is a cutaway top plan view of one octave of the prior art form of the uniform keyboard with standard-sized keys.
FIG. 3 is a cutaway perspective view of the frontal portions of a mechanical graphic keyboard.
FIGS. 4*a* and 4*b* respectively show left and right portions of a shortened 7 ½ octave mechanical graphic keyboard in top plan view.
FIG. 5 is an enlarged sectional view of a lower case mechanical graphic keyboard key taken along 10—10 of FIG. 4*a;*
FIG. 6 is an enlarged cutaway top plan view of several mechanical graphic keyboard keys illustrating their rearmost portions extending into a typical key action assembly.
Figures 7, 8, 9, 10, 11, 12:
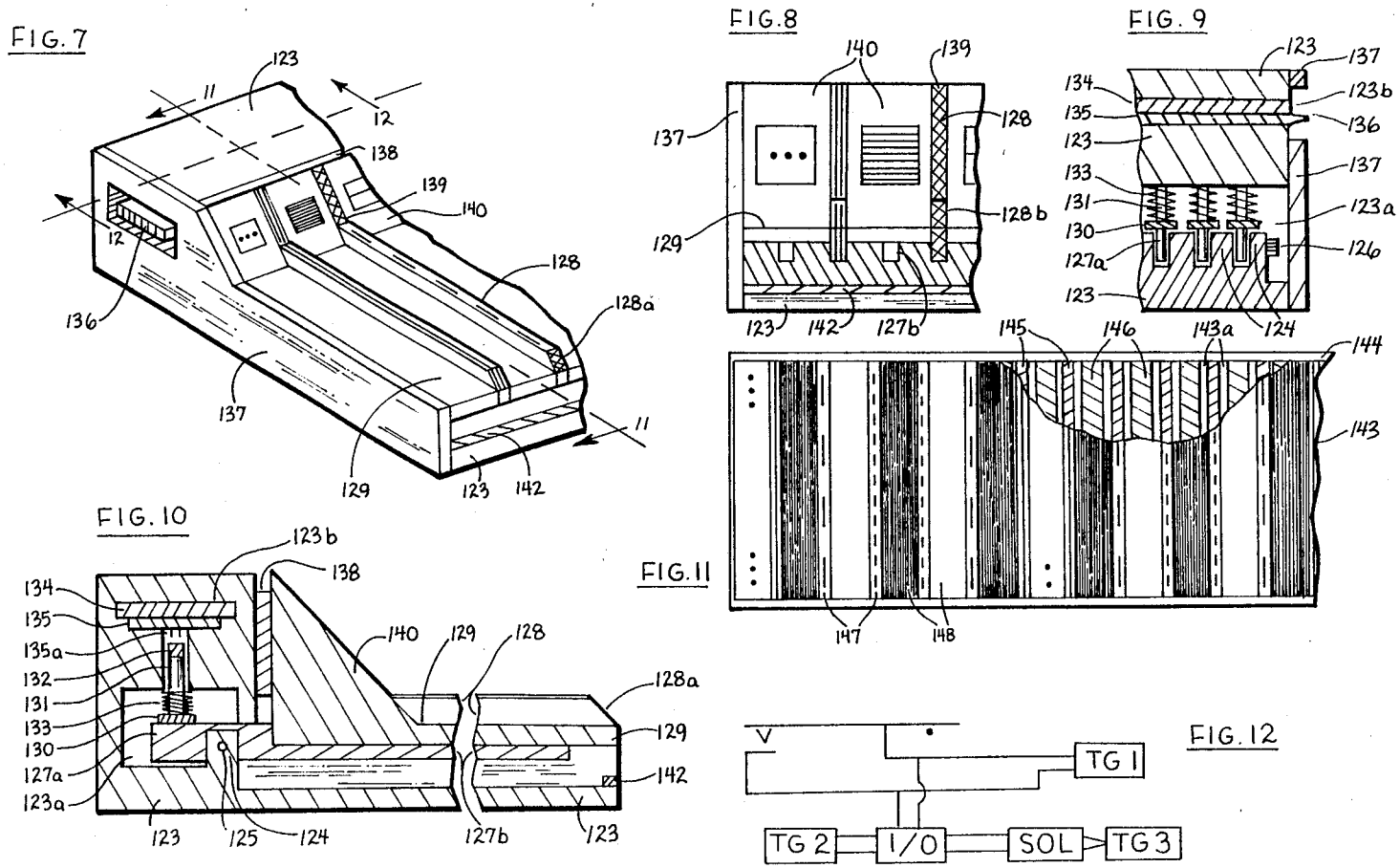
FIG. 7 is a cutaway front perspective view of the leftmost portion of a four octave electric graphic keyboard.
FIG. 8 is an enlarged cutaway front plan view of FIG. 7.
FIG. 9 is a rear cutaway section view of the first three keys of FIG. 7 taken along 12—12.
FIG. 10 is an enlarged and shortened side sectional view of FIG. 7 taken along 11—11.
FIG. 11 is a cutaway top plan view of the left two octaves of a touch sensitive membrane electric graphic keyboard revealing the underlying switch contact areas.
FIG. 12 is a diagrammatic view of the electric circuits typically utilized by the electric keyswitching means of the electric graphic keyboard.

Referring now to the drawings, FIGS. 1*a* and 1*b* together illustrate a shortened 7 ½ octave standard keyboard and FIG. 2 illustrates a typical uniform keyboard octave. FIGS. 4*a* and 4*b* together illustrate a shortened 7 ½ octave mechanical graphic keyboard, which embodiment is further shown in a perspective cutaway view in FIG. 3. Each of the prior art forms and the embodiment of the invention perform the same specific function which is to serve as the keying means for actuating a mechanical piano-type key action. The standard-sized lower case keys of the respective prior art forms 101, 102 are typically 5 ½" to 6" in length with a typical frontal width of ⅞" to 1", whereas the lower case keys of the mechanical graphic keyboard 103 are typically 5 ½" to 6" in length with an average uniform width of ⅞". The typical length of the standard upper case keys 104, 105 is 3 ½" to 3 ¾" with a typical 7/16" uniform width and a typical ⅜" height from the planar surface of the respective lower case keys 101, 102, whereas the upper case keys of the mechanical graphic keyboard 106 are typically 5 ½" to 6" in length with an average uniform width of ⅛" and with a typical ⅜" rise from the planar surface of the lower case keys 103. The respective narrower and wider keys of the invention 106, 103 are thus designed to be essentially coextensive and of average uniform widths, whereas the width of the lower case keys 101, 102 of the prior art forms narrows to a typical ½" where the lower case keys 101, 102 enter between the raised key sets 104, 105. The graphic keyboard embodiment maintains the overall transverse length of the standard keyboard by maintaining the standard octave length of an average 6 ½" so that the embodiment may more easily act in lieu of the standard or uniform keyboard when suitably attached to the standard key action assembly. FIG. 6 shows an enlarged cutaway view of several mechanical graphic keyboard keys 103, 106 passing beneath the upper key action panel 121 into their respective endpiece portions 107, 108, which then further extend into the key action assembly (not shown). To allow for unobstructed endpiece movement during depression of the keys 103, 106, the endpieces 108 of the upper case keys 106 are recessed approximately ¼" to the rear of the lower case keys 103. FIG. 5 shows an enlarged sectional view of a lower case key 103 taken along section line 10—10 of FIG. 4*a* along with a side view of an upper case key 106 shown directly behind the lower case key 103. Each lower case key 103 has provided an alternate guide pin means which consists of a ⅛" wide by approximately ½" deep and approximately 2" long rigid metal or plastic guide member 109 inserted into the wooden body of the lower case keys 103 and molded to be a part of the body of the upper case keys 106 for added strength. Generally the lower case key body will have a plastic covering 103*a*, as will the upper case key body (not shown) when made of metal. The guide members 109 are positioned to be slidably reciprocable within appropriately fitted rectangular openings and in a bushing cloth boot 110 positioned within said rectangular openings passing downward respectively through the front rail 111 and keyframe 112, which typical standard assembly then rests attachably upon the lower keybed 113 and is forwardly contained by the frontal panel or keyslip 114. At the bottom of said rectangular openings is a felt or rubber guide member cushion 109*a* which is suitably affixed to the top of the keybed 113 within said opening. When the respective keys 103, 106 are depressed their typical full ⅜" travel distance, the guide members 109 travel downward through said rectangular openings within said bushing cloth boot 110 until the bottom of the guide members 109 contacts the respective cushions 109*a*. Upon release the respective keys 103, 106 are restored to their level rest positions by the standard key action assembly. If greater travel distance is required between the bottom of the respective keys 103, 106 and the top of the front rail 111, the guide member cushion may be replaced by a key cushion at 110 affixed suitably to the top of the front rail 111 and suitably slotted to accomodate the guide member 109. Typically the respective keys 103, 106 will have 1/32" to 1/16" side gaps as do typical standard key arrays to provide for the proper spacing of the keys within the key action assembly. Since the mechanical graphic keyboard embodiment normally uses a C-tone lower case space-related keying system, in a full 7 ½ octave keyboard format the lowest A-tone key 115 will fall in a line-related position thus requiring a false portion of a lower case space-related key 116 to be either added into the body of the A-tone key 115 or otherwise affixed to the keyboard's left sidepiece 117*a*. At the opposite keyboard end the highest C-tone lower case key 118 will generally be made slightly wider than the other lower case keys 103 to compensate for the absence of any further keys before reaching the right sidepiece 117*b*. If the respective keys 103, 106 are manufactured with angled risers 119, 120, which will be later explained in terms of the graphic referencing method, these will generally come to rest against a suitable cushioning strip 122 affixed by adhesives in a horizontal manner against the front surface of the upper key action panel 121 when the keys 103, 106 are in their level rest positions. If said panel 121 is not present the risers 119, 120 will then protrude upward from the surface planes of said keys. Normally a 1:1 length ratio will be used for the respective keys 103, 106 to maintain a sense of uniform coextensiveness; however, alternate embodiments may be made wherein the preferred 1:7 key-width ratio is maintained but the length of the upper case keys 106 slightly reduced in length to allow for a slightly longer thumb-little finger reach then unobstructed by the frontal portions of the upper case keys 106. The upper case keys 106 will normally be manufactured with squared top surfaces with various striations thereupon both to minimize finger slippage and to comply with certain linear coded tactual referencing requirements yet to be explained. Normally the frontal portions of the upper case keys will be squared at a right angle to the plane of the key top surface, but may be alternately made to angle downward as shown in FIG. 7 to facilitate the visibility of the graphic referencing indicia. Although the mechanical graphic keyboard just described would normally be utilized to actuate a piano-type mechanical keyboard action mechanism, the same essential embodiment as just described may be otherwise utilized to play out a different form of key action as would for example be utilized to strike sonorous materials beneath the guide members.

DESCRIPTION AND OPERATION OF ELECTRIC GRAPHIC KEYBOARDS

The graphic keyboard design of essentially coextensive narrower and wider alternately arranged keys may be alternately embodied as an electric keyswitching means for the actuation of a tone generator means, or any other chromatically scaled electrical devices such as lights or cooperative electromechanical valves. As with standard keying arrangements for switching circuits as displayed in terms of FIG. 12, the electric graphic keyboard may be utilized to directly key a first tone generator means TG1, or to key a second tone generator means TG2 indirectly through an input/output circuit means I/O remotely coupled to the second tone generator means TG2, or may be utilized through said input/output circuit means I/O to remotely key-actuate a solinoidal means SOL further actuating a third tone generator means TG3. FIGS. 7 through 10 illustrate an electric keyboard embodiment intended for use with a computer generated musical sound source, with the further capacity of being used interactively with a computer music-write program as will be later explained. The embodiment of FIG. 11, which is a touch sensitive membrane keyswitching version of an electric graphic keyboard, may also be used in the manner of a computer interactive keyboard. FIG. 7 shows a cutaway frontal perspective view of the leftmost portion of a multioctave electric graphic keyboard. FIG. 8 shows an enlarged front plan view of FIG. 7, and FIG. 9 shows an equally enlarged rear section view of FIG. 7 taken along 11—11 and 12—12. FIG. 10 illustrates an enlarged side section view of FIG. 7 taken along 11—11 and shortened to allow a view of both rear and front ends. The embodiment of FIGS. 7 through 10 consists of a molded plastic frame 123 with a slotted keyblock 124 into which a suitable metal common hinge rod 125 has been inserted through a series of round apertures (at 125) provided in the respective portions of the slotted keyblock 124 along its transverse length. The common hinge rod 125 is provided with threaded ends (not shown) and locked into position and tensioned by a threaded cap nut 126 screwed onto the respective threaded a common hinge rod ends. The common hinge rod then also passes through respective provided apertures in the respective molded plastic rear lever arms 127*a* forming the lower rearmost portion of the respective, alternately arranged and essentially coextensive molded plastic upper case keys 128 and lower case keys 129. The rear lever arms 127*a* and front lever arms 127*b* and the respective keys 128, 129 are individually molded as one lever arm-key unit. When mounted upon said common hinge rod 125, the upper surfaces of the rear lever arms 127*a* respectively rest against the undersurfaces of the switch plunger lower ends 130. The switch plunger 131 is then a cylindrical plastic piece with a lower, larger cylindrically sectioned lower end 130 and a conductive rubber upper end 132. Said plungers 131 are then held in an extended downward position against said upper surfaces of the rear lever arms 127*a* by a suitably tensioned coil biasing spring 133 which is coiled about the plunger and exerting tension between the upper surface of the plunger lower end 130 and the underside of a lower transverse space molded into the upper portion of the plastic frame 123*a*. The upper conductive rubber end of the plunger 132 is then positioned to be vertically reciprocal within a suitably sized cylindrical aperture provided between the underside of the lower transverse space in the plastic frame 123*a* and the upper transverse space 123*b*. In said upper transverse space is slid a transversely positioned plastic mounting plate 134 with suitably attached flexible plastic printed standard computer keying circuit 135 with suitably positioned sets of circuit contact points 135*a* above the said plunger apertures in the upper frame transverse space 123*b*. Said slidably affixed mounting plate 134 with printed circuit 135 terminates in an input-/output multiconnection interface connector 136. The molded plastic left sidepiece panel 137 has then a rectangular portion removed (at 136) to allow for passage of a suitable standard-sized counterpart connector for remote connection with a tone generator means. The left sidepiece panel 137 is then suitably affixed to the plastic frame 123 with adhesives or recessed screws (not shown). The right side panel would then be similarly made and affixed or may be molded into the frame 123.

During operation the respective upper case keys 128 and lower case keys 129 are respectively depressed away from a level rest position against the upper front frame cushioning strip 138 which is made of suitable material for a noise-dampening effect and affixed by adhesives horizontally along the transverse length of the upper frame 123 to the rear of the key referencing risers 139, 140, which risers are then a part of the molded key bodies 128, 129. Depression of the respective keys 128, 129 causes them to respectively rotate on the common hinge rod 125 through a maximal travel distance of ½" after which the undersides of the frontal portions of the keys come to rest against a suitable cushioning strip 142 affixed by adhesives to the lower front extended portion of the frame 123 along said frame's front inside transverse length. As said keys 128, 129 incur depression and rotation about the hinge rod, their respective rear lever arms 127*a* rise and exert upward pressure against the undersides of the plunger lower ends 130 causing the plungers 131 with conductive rubber upper ends 132 to rise and exert pressure on the coil springs 133 until the conductive rubber ends 132 electrically connect the contact points 135*a* in the printed circuit 135 with pressure exerted against the mounting plate 134. Said keying contact points 135*a* then close a common bus lead for the keying circuits to which they apply within the standard sequential positions for an ascending order of semitone positions in the equivelently ordered tone generator means as was discussed in terms of FIG. 12. When said keyswitching means just described is disconnected by release of said keys 128, 129, the biasing springs 133 expand and restore the plungers 131 to their described rest position and so push the rear lever arms 127*a* down and restore the keys 128, 129 to their level rest position against the back strip 138. The slotted frame block 124 is then functionally equivelent to the slotted guiding means of FIG. 5 110 in that said keyblock 124 prevents any extreme lateral movement of the keys 128, 129. Various alternate embodiments of the electric graphic keyboard are possible wherein the switch actuation method is slightly altered, as for example when the switching means is elsewise positioned under, or forward or rearward relative to the keys.

FIG. 11 shows a top plan view of the left two octaves of a four-octave touch sensitive membrane electric graphic keyboard 143 positioned attachably within a surrounding plastic box frame 144. The graphic keyboard design of alternating thin and wide coextensive keys has been suitably marked as a planar design upon the flat top plastic keying area of a touch sensitive switch assembly whose sub-structural switching means has been illustrated in the cutaway portion of FIG. 11. Said switching means consists of a series of uniformly lengthed alternately arranged narrow strips 145 and wide strips 146 appropriately positioned beneath the alternately arranged narrow and wide coextensive keying area designs 147, 148 imprinted on the top surface of the touch plate 143. The lower case switch contact strips 146 beneath the lower case designs 148 are made with a reduced width relative to the superposed designs to provide a larger order non-conductive longitudinal area 143*a* between the respective contact strips 145, 146, thus allowing a finger width of ⅞" placed upon a narrow key design 147 to actuate its sub-structural switch strip 145 without unwanted depression of an adjacent strip 146. The top surface of the touch plate 143 has provided a friction producing grating positioned within the ⅛" narrow designs 147 to minimize finger slippage away from said narrow designs. The connector port of the touch plate embodiment with suitable interface connector means and standard circuit means as was described for the embodiment of FIGS. 7 through 10 would then be contained within the plastic box frame 144. Alternate touch switch assemblies may be similarly arrayed but in a bi-planar format wherein a plastic touch plate is suitably raised where required to present a raised narrow key array. In a bi-planar embodiment the sub-structural contact strips 145, 146 would be manufactured to more closely approximate the respective widths of the alternating key designs 147, 148. Alternately the respective frames of the various electric keyboard embodiments could be provided with friction producing bottom strips or suitable foot pads. And alternately, the various individual hinging means utilized with standard electric keyboards could be adapted for use with electric graphic keyboards. Normally an electric graphic keyboard embodiment will utilize a lower case C-tone method of chromatic tone keying order to cooperate with the hexaline scoring method yet to be explained. In larger scales of physical dimensioning both mechanical and electric graphic keyboards may be foot-operated, and in altered frame formats used in a slung manner.

DESCRIPTION AND OPERATION OF GRAPHIC OVER-KEYBOARDS

It is important to understand that the graphic keyboard design illustrated by FIGS. **4*a*–4*b* represents a universally applicable keying means for a chromatically scaled keyboard whether the tone generator means being utilized is of a strictly mechanical or additionally electric nature, and whether or not the narrowed keying areas are embodied in a raised or non-raised format. The essence of the invention of a graphic keyboard for use within the context of the Graphic Music System invention is thus in the novel and unique effect produced by utilizing alternately arranged essentially coextensive uniformly narrowed and widened keying surfaces. Moreover, because of the general requirement for all graphic keyboard embodiments to maintain standard distancing dimensions to facilitate the utilization of the graphic keyboard design in lieu of a standard keying array, it becomes obvious that were the respective narrow keys 106 and wider keys 103 of the described embodiment of FIGS. 4*a*–4*b* transversely connective by means of a common hinge rod with the composited key array assembly then positioned over a standard or uniform dimensioned key array, that the guide members 109 would respectively superpose their musical counterparts in the key array set thereunder. Thus the graphic keyboard design with but slight modifications and improvements is generally equivelent to an over-keyboard keying means for a standard or uniform keyboard. FIGS. 13*a* through 16** then exemplify the use of the graphic keyboard design as an over-keyboard for the standard keyboard. In this preferred embodiment of the graphic keyboard design as a graphic over-keyboard a mechanical linkage assembly has been added to facilitate the use of the embodiment with a variety of standard keyboarded musical instruments, as will be explained forthwith.

Figures 13A, 13B, 14A, 14B, 15, 16:
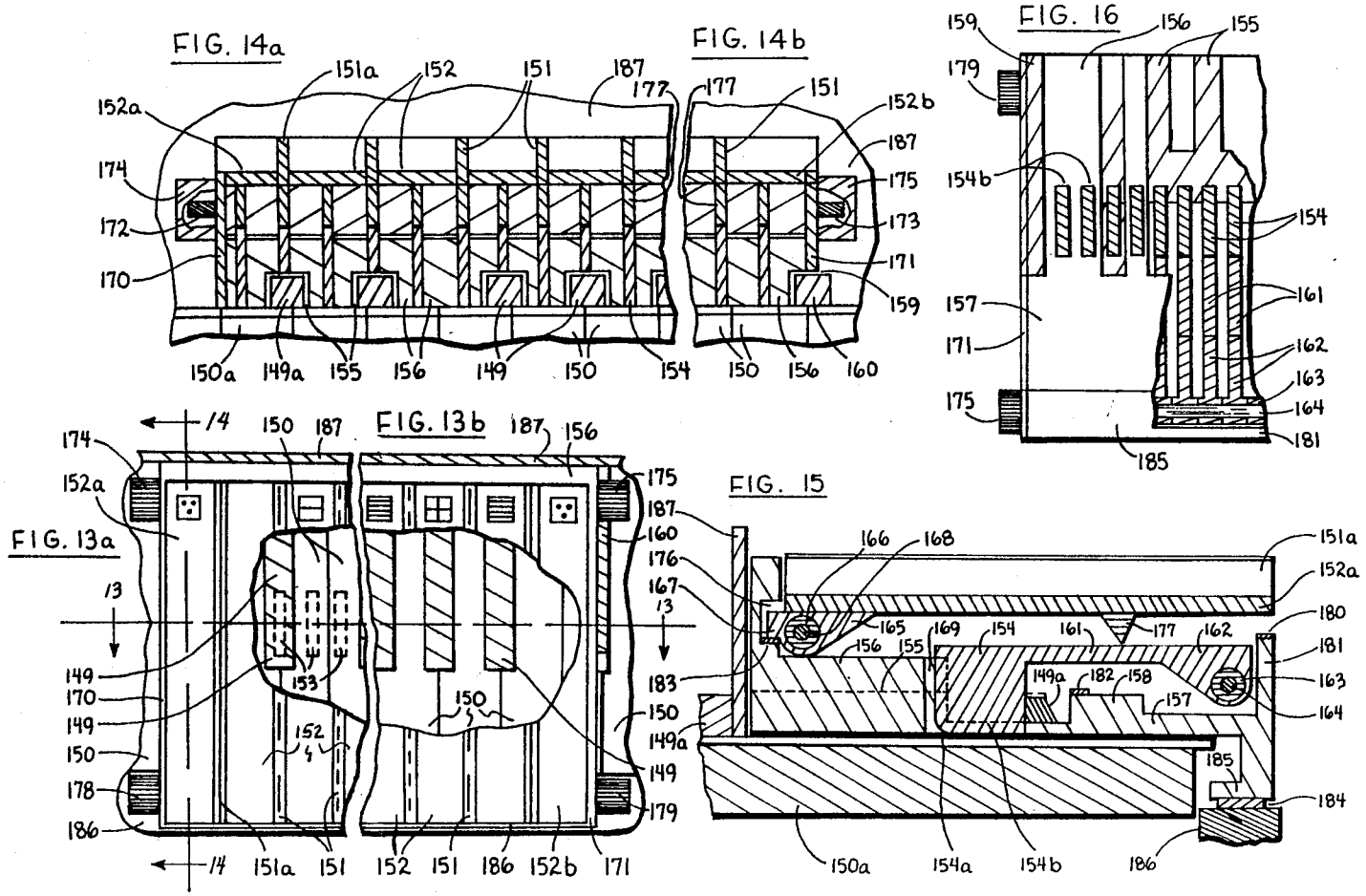
FIGS. 13*a* and 13*b* respectively show a top plan view of the extreme left and right portions of a four octave graphic over-keyboard cutaway to reveal the standard keyboard positioned thereunder.
FIGS. 14*a* and 14*b* respectively show an enlarged cutaway sectional view of an extended left portion and shortened right portion of FIGS. 13*a*–13*b* taken along 13—13.
FIG. 15 is an enlarged side sectional view of FIG. 13*a* taken along 14—14.
FIG. 16 is a bottom plan view of FIG. 13*b* detached from the standard keyboard and cutaway to reveal the contact member assembly.

When the graphic keyboard design is utilized as a graphic over-keyboard attachably removable from a standard keyboard, the over-keyboard becomes a graphic keying means for the standard keyboard and so provides a means for a uniform keying arrangement wherein each respective over-key effectively produces a tone one-half note different from that produced by either of the keys adjacent thereto. FIGS **13*a*–13*b* show a cutaway top plan view respectively of the extreme left and right portions of a four-octave graphic over-keyboard embodiment slidably mounted upon a standard keyboard key array with portions of the standard keyboard keys 149, 150 revealed in the cutaway portion of the respective figures to illustrate the longitudinal superpositioning of the graphic over-keyboard keys 151, 152 over the standard keys 149, 150 with dotted outlines 153 in FIG. 13*a* indicating the rectangular rest contact points 153 of the lower contact member 154 undersurfaces upon the top surfaces of the standard keys 149, 150. FIGS. 14*a*–14*b* illustrate an enlarged extreme left and right sectional view of FIGS. 13*a*–13*b* taken along section line 13—13. FIG. 15 illustrates an enlarged side sectional view of FIG. 13*a* taken along section line 14—14. FIG. 16 shows a bottom plan view of FIG. 13*b* detached from the standard keyboard and cutaway to illustrate the contact member and lever arm assembly. When the graphic over-keyboard embodiment is superpositioned upon the standard keyboard, the upper case standard keys 149 are unobstructably accomodated by ½" wide, ⅜" high longitudinal accomodation slots 155 molded into the rear transverse member 156 of the reinforced plastic frame 157. The upper case standard keys 149 enter the frame 157 from the rear during slidable attachment of the graphic over-keyboard to the standard keyboard and are moved forward through said accomodation slots 155 to a rest position adjacent to the front transverse member 158 portion of the frame. Said accommodation slot 155 is shown in FIG. 15 by a dashed line drawn from the rear entry point of the standard upper case key 149*a* to the appearance of the key 149*a* as it exits said slot 155. As illustrated in FIG. 14*b*, a partial longitudinal accomodation slot 159 is molded into the extreme right portion of the lower frame rear transverse member 156 to accomodate the right end upper case standard C#-tone key 160 positioned external to the over-keyboard frame 156. Whereas this partial slot 159 is not required on a typical four-octave standard keyboard which has no extreme right C#-tone upper case standard key, said slot 159 is provided to allow the over-keyboard to be utilized with any larger-octaved standard keyboard wherein said C#-tone key 160 would appear. The side sectional view of FIG. 15 illustrates the longitudinal plane of a typical lower case over-key for a C-tone 152*a* superposed over its correspondent lower case standard key for a C-tone 150*a*. The top portion of an upper case over-key for a C#-tone 151*a* is equivelently shown superposed over its correspondent upper case standard key for a C#-tone 149*a*. This arrangement is shown in frontal sectional view in the leftmost portion of FIG. 14*a*. It should be noted that the proper standardized sizing of the graphic over-keyboard for a four-octave standard keyboard system requires that the leftmost C-tone over-key 152*a* be made slightly narrower than the other lower case over-keys 152 to allow for the common endpieces in a four-octave standard keyboard system, and that similarly the extreme rightmost C-tone over-key 152*b* is made slightly wider than the other lower case over-keys 152 to cover the full four-octave standard distance. In the frontal view of FIGS. 14*a*–14*b* a plurality of contact members 154 are shown in their rest position beneath the respective longitudinal axes of the respective over-keys 151, 152 with the respective undersurfaces of the contact members 154 shown resting upon the top surfaces of the respective standard keys 149, 150. This arrangement is exemplified in the side sectional view of FIG. 15 wherein a contact member 154 is illustrated in its rest position beneath the lower case C-tone over-key 152*a* and upon the top surface of the lower case C-tone standard key 150*a*. The cutaway portion of FIG. 16** then illustrates the parallel arrangement and uniform spacing of the contact members 154 as they appear in relation to the respective accomodation slots 155 in the rear transverse member 156 in its flat bottom portion. Whereas the respective upper case over-keys 151 and lower case over-keys 152 are uniformly sized, with the previously note exceptions, 152*a*, 152*b*, the respective contact member 154 vertical lengths are appropriately sized to correlate with the differing distances between the contact member 154 top surfaces and the top surfaces of the respective standard keys 149, 150 which they respectively rest upon and which they respectively actuate during the operation of the over-keyboard. The respective contact members 154, connective lever arms 161, contact member hinge mounts 162, and cylindrically sectioned spacers 163, are one molded plastic piece, each with a 3/16" aperture which has been (at 164) provided for the introduction of a contact member common hinge rod 164. The respective over-keys 151, 152 with connective over-key hinge mounts 165, cylindrically sectioned over-key spacers 166, and extended tailpieces 167, are also respectively manufactured as one molded plastic piece, with a provided rear 3/16" aperture (at 168) for the introduction of a common over-key hinge rod 168. The plurality of respective contact members with lever arms and hinge mounts are minimally ⅛" wide with suitably wide spacers. Each such contact member piece in the assembly is longitudinally positioned with its front vertical portion 154 slidably embraced by vertical accomodation slots 169 provided in the rear transverse member 156. A contact member 154 which actuates a lower case standard key 150 as shown in FIG. 15 150*a* has a full length vertical slot 169 within the rear transverse member 156, whereas a contact member for an upper case standard key 151*a* has only a partial vertical slot which then passes into the upper case standard key accomodation slot space 155. Said contact member vertical accomodation slots 169 are provided to slidably restrict the lateral movement of the contact members 154 during their vertical reciprocal motion when engaging the standard keys 149, 150 positioned thereunder. The lower portion of the respective contact members which slidably engages the standard keys (at 154*a*) is appropriately curved to facilitate said sliding motion, and the respective rectangular slots in the bottom portion of the rear transverse member as illustrated in FIG. 16 at 154*b* are appropriately sized to allow ease of reciprocal sliding motion by said contact members through said slots. Said rectangular slots are then also suitably gapped forward and rearward to allow for a limited amount of forward and rearward travel of the contact members which occurs during slidable engagement of the standard keys thereunder.

The respective over-keys 151, 152 are alligned in a parallel manner on their metal hinge rod 168, appropriately distanced by suitable sizing of their said spacers 166 which are then fitted slidably flush against one another along the transverse length of said hinge rod 168. Said hinge rod 168 then passes slidably at both ends through provided 3/16" apertures in the vertical side panels 170, 171 respectively terminating in the threaded ends 172, 173 shown in cutaway view within their respective plastic screw-on threaded tensioning knobs 174, 175 in FIGS. 14*a*–14*b*. This flush mounting of the over-keys provides a limited lateral stability for the over-keys which is then further enhanced by the respective over-key tailpieces 167 which are slidably engaged within respective appropriately sized vertical slots 176 provided within the rear vertical portion of the upper rear transverse member 156, and limits the lateral movement of the over-keys across the typical 1/32"–1/16" gaps between the over-keys. Each respective over-key 151, 152 has a triangular wedge 177 molded into the forefront underneath portion of the respective key bodies whose lowermost point rests in direct contact with the upper mid-portion of the contact member lever arm 161. Said lever arms 161 alligned in a parallel, uniformly spaced manner on said metal hinge rod 164 are appropriately distanced from one another by the cylindrically sectioned spacers 163 which are fitted slidably flush against one another along the transverse length of said hinge rod 164 with said hinge rod then slidably passing at both ends through provided 3/16" apertures in the vertical side panels 170, 171 with said hinge rod ends terminating in threading which screws into their respective plastic screw-on tensioning knobs 178, 179. This flush mounting of the contact member lever arms plus the aforementioned contact member vertical slots 169 together provide full lateral stability for the contact member assembly. The molded plastic side panels 170, 171 are affixed to the frame sides by means of adhesives or recessed screws. A suitable form of noise-dampening strip 180 is affixed by adhesives to the top transverse surface of the front vertical panel 181 portion of the frame 157, and an equivelent strip 182 equivelently affixed by adhesives is positioned upon the top front surface of the front transverse member 158. A third equivelent strip 183 equivelently affixed is provided along the transverse length of the small vertical portion of the upper rear transverse member directly beneath the respective tailpieces 167 to the front of the vertical tailpiece slots 176. At level rest position, said tailpieces 167 rest against said strip 183. A mounting strip 184 or strips of 1/16" double-faced adhesive tape material is used to couple the lower frame foot 185 to the musical instrument's front vertical panel or inclined panel or keyslip 186. The lower frame foot 185 extends ¾" below the frame bottom and is provided with a recessed open area above the foot 185 to allow the front and top leading edge of the lower case standard keys 150*a* and 150 generally to slide unobstructedly into said lower frame foot recessed area thus allowing the lower portion and bottom surface of the lower frame foot 185 to reach a solid support point on the instrument front panel 186 utilizing the intervening coupling strip 184. On standard keyboards such as the Conn organ which has a recessed keyslip panel, an extended rigid version of the coupling strip 184 would be utilized to provide support for the frame foot 185 upon said recessed panel.

The preferred length of the coextensive over-keys 151, 152 is 6" to allow the over-keyboard to generally reach the full distance from the keyslip to a point near the rear vertical keyboard panel 187. Once the over-keyboard has been slidably positioned on the standard keyboard as previously described, the lower frame foot 185 is matched against the instrument's front panel top surface 186 to determine if further leveling is required. If the coupling strip 184 provides proper leveling the embodiment is pressed down to exert pressure between the lower frame foot 185, double-faced adhesive mounting or coupling strip 184 and the top surface of the instrument panel 186. If required multiple strips 184 may be utilized to increase the mounting distance. If the drop distance between the top surface of the lower case standard keys 150 and the bottom surface of the lower frame foot 185 is less than ¾" the positioning of the lower frame foot mounted as described on the front panel will incline the embodiment slightly upward from the rear to the front. This presents no problem as the over-keys will then drop to a self-leveling rest position as the lower connective contact members 154 will accordingly drop through their respective lower frame slots **154*b* as shown by the horizontal dotted line in FIG. 15 to reach a rest position against the top surfaces of the lower case standard keys with the accomodating slots 155 then inclined slightly away from their enclosed keys. Overall performance is not affected by any mounting height differences because the primary weight support for the embodiment is distributed along the transverse length of the lower frame foot to instrument vertical panel coupling, with the remaining weight being distributed across the transverse length of the top surfaces of the lower case standard keys 150**. In a typical four-octave embodiment such as has been described, said rearmost weight would fall across twenty-nine lower case standard keys, and thus even if multiple lower case standard keys were simultaneously depressed by the over-keyboard action, the remaining standard keys would adaquately support the rearmost weight of the embodiment.

To utilize the over-keyboard embodiment with a standard keyboard, said embodiment is slidably attached as described with further determinations being made that the upper case standard keys 149 are not being internally obstructed by pressure against the front transverse member 158, nor the lower case standard keys 150 being obstructed by pressure against the recessed portion of the lower frame foot 185. Said determinations are made by testing various over-keys to see if they are depressible and if they return to a rest position from the upward action of the standard keyboard return action. If obstructions occur these are corrected by repositioning the embodiment until a proper return occurs.

In terms of mechanical operation, the manual depression of any over-key 151, 152 in the embodiment rotates that particular over-key on its hinge mount 165 away from its rest position on the over-key common hinge rod 168 moving the over-key tailpiece 167 slidably upwards in its vertical slot 176 and moving the triangular wedge 177 beneath said over-key downward thus exerting pressure upon and depressing the contact member lever arm 161 causing it to rotate away from its rest position and connectively carrying the contact member 154 downward through its vertical guide slot 169 and bottom frame slot **154*b* below to further slidably engage at 154*a* and exert downward pressure upon the standard key 149 or 150** positioned thereunder, moving said standard key from its rest position into an actuation of its key action mechanism. Once the over-key is released, the standard key action mechanism acts connectively to exert upward pressure in turn on the standard key, contact member, lever arm, triangular wedge, and so over-key to return said over-key to its rest position.

It should be noted that whereas the over-keys 151, 152 may drop only a typical distance of 5/16" before being stopped with a cushioned impact on the noise dampening strip 180, the standard key thereunder may be depressed up to a typical maximal distance of ½" to allow for a typical maximal drop distance of ½" for a standard key. Whereas various standard keyboard models do not have keys which fall this maximal distance so that a graphic over-keyboard embodiment would be adaquate if only provided with a contact member affixed directly to the underside of each respective over-key in the described manner of the mechanical graphic keyboard embodiment, since the user of the graphic over-keyboard may have to deal with the said maximal drop distance, the mechanical advantage provided by the contact member lever arm assembly is preferable. The described embodiment is also preferable because it places the primary depressional pressure and leverage points at a frontal position relative to the over-keys to provide a more uniform touch response with respect to the standard keys positioned thereunder, and because it effectively places the playing pressure upon the frontal lower frame foot support rather than at the middle or rear portion of the standard keys.

Whenever it is necessary the graphic over-keyboard may be slidably removed from the standard keyboard by lifting the front frame upwards thereby detaching the frame foot mounting strip and then pulling the over-keyboard forward and free from the standard keyboard, thus allowing the standard keyboard to again be played in the conventional manner. The graphic over-keyboard may be manufactured in any length, and at full piano size would appear in top plan view as does the mechanical graphic keyboard of FIGS. **4*a*–4*b*. The over-keyboard may also be manufactured as a box system of plates appropriately slotted in the manner of the plastic block frame 157. The common hinge rods 164, 168 could be replaced by independently movable hinging means with accordingly differing pivotal over-key and lever arm mounts. Or alternately, the said hinge rods may be set into hinge cupping means molded into the side panels 170, 171. The described knobbed version is preferable because it allows tensioning adjustments to be made against the inner spacer assemblies. The contact members 154 could be alternately made as a wheel assembly or done in other various shapes such as a half-circle or triangles or could be replaced by sliding plunger rods. Alternately, the contact member lever arms 161 and hinge mounts 162 could have tailpieces equivelent in structure and function to the over-key tailpieces 167 and slots would then be provided for such extensions in the front vertical panel 181. The over-keys and/or contact member arms could have provided additional return spring means to assist their return to level position after depression. The over-keyboard front support means could be altered to become a vertically adjustable stud and lock nut assembly in lieu of the provided transverse foot support 185**, or could rely on various end piece support means. The provided support means is preferable because it avoids any serious protrusion into the surrounds of the standard keyboard on which the embodiment rests thereby avoiding interference with the various controls of the electrophone keyboards or the back panel portion of a typical piano. Moreover, the given embodiment is suitable for use with a typical four-octave music synthesizer irrespective of the angular nature of the side piece design adjacent to the ends of the standard keyboard. The particular embodiment of the graphic over-keyboard described is thus preferable because it minimizes components and assembly steps while providing sufficient strength and stability to perform well with any standard keyboard.

While the above description of graphic keyboard and over-keyboard embodiments contains many specificities, these should not be construed as limitations on the scope of the invention, but rather as an exemplification of several preferred embodiments thereof. Many other variations are possible, for example, the chromatic arrangement described for the various embodiments could be further enhanced by adding a higher portion to the keys related to the diatonic scale at the rearmost region occupied by the referencing risers so that a sliding diatonic scale effect might be obtained while retaining the graphic design described. Or alternately, the respective over-keys of the graphic over-keyboard could be modified into the various forms suggested for the mechanical and electric embodiments to provide a better interpretation of the related indicia, yet to be explained, and the graphic over-keyboard frame could be provided with a friction producing means for its bottom plate to lessen lateral slippage when mounted upon the standard keyboard, and also be provided with suitable soft material spacers at the rear of the frame to reduce the possibility of marring musical instruments to which it may be slidably attached. Accordingly, the scope of the invention of a Graphic Music System as it applies to the graphic keyboard design embodiments should be determined not by the embodiments illustrated, but by the appended claims and their legal equivelents.

DESCRIPTION AND OPERATION OF THE GRAPHIC SCORING METHOD

Figures 17, 18, 19, 20, 21, 22:
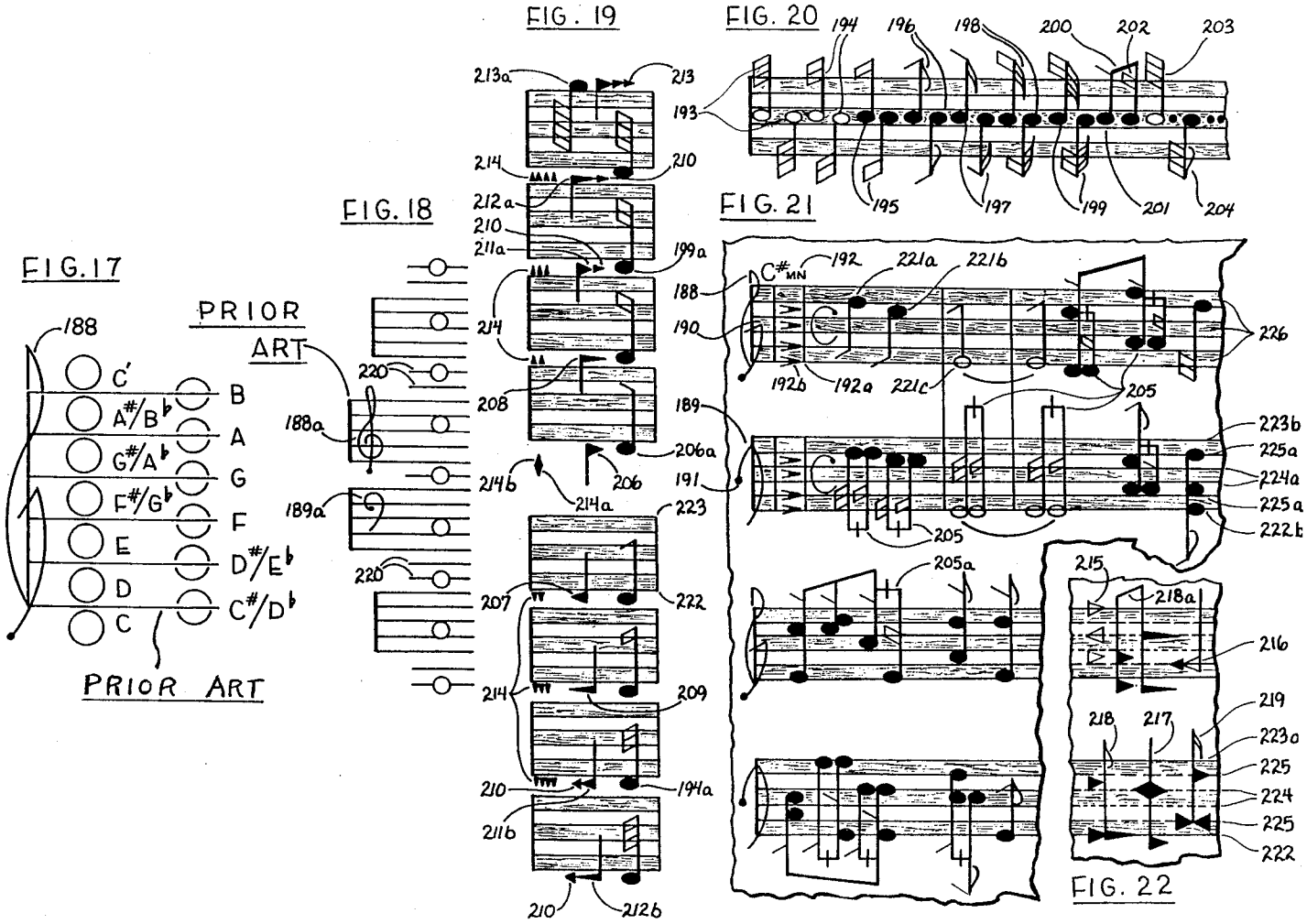
FIG. 17 PRIOR ART
FIG. 17 shows the prior art form of a single hexaline staff.
FIG. 18 shows the prior art form of an eight octave pentaline staff system.
FIG. 19 shows an eight octave hexaline stacking array with two forms of octave-designating notation.
FIG. 20 shows a hexaline stack with oval-flagged octave-designating notation.
FIG. 21 is a face view of a cutaway portion of a musical score done in terms of a double stack system and oval-flagged notation.
FIG. 22 is a face view of a cutaway portion of a musical score done in a linear coded double stack system with triangular octave-designating notation.

The graphic scoring means invention of the Graphic Music System invention has been essentially derived from improvements added into the basic concepts set forth in the prior art form of the uniform music system scoring means invention illustrated in FIG. 17. Therein is shown a scoring method consisting of six horizontal evenly spaced or "stacked" parallel lines which then have two implied spaces respectively below and above the hexaline stack. The lower implied space is utilized to designate a lower C tone or note position written as C in FIG. 17, and the higher implied space is then utilized to designate a higher C position, written as C'. The twelve octave tones or notes are then written on the hexaline stack in a uniform order of the ascending pitch positions of C through C' with the respective lines and spaces of said hexaline stack then being used to designate the respective pitch levels. Each tone or note letter has then a circular noteform adjacent to it to indicate precisely which line or space is the equivelent symbol for that pitch level, with C initiating one lower octave order and C' indicating the next higher octave order. Ledger lines may then be added to this basic staff or stack conception of scoring to continue the process of recording pitch levels or separate multiple staff systems may be employed in a parallel manner similar to the stacked set of staffs shown in FIG. 19. The stacking system scoring means of FIG. 19 is then different from the five-line or pentaline scoring means invention of the Standard Music System which is illustrated generally in FIG. 18 which shows an eight-octave pentaline scoring method with extended ledger lines for visual clarity and with its nine C tone or note positions indicated thereupon by unmarked circular noteforms. The mutliple staffs and ledger lines and spaces of the pentaline system of FIG. 18 indicate diatonic pitch by the positioning of oval noteforms on one of the twenty-nine lines or thirty spaces of said pentaline system, with accidental pitch positions being indicated by the addition of precessional notation signs before the natural tone positions (not shown). FIG. 19 shows an eight-octave hexaline stack system marked in terms of the invention of a graphic scoring means. Each of its nine C-pitched positions have been indicated both by stemmed oval noteforms and by stemmed triangular noteforms, with smaller equilateral triangular markings provided in the C-pitched space positions, the central diamond symbol then being formed from two equilateral triangular markings taken together.

The primary difference between the way in which pitch is designated on the pentaline scoring means of FIG. 18 and the graphic scoring means of FIG. 19 is that the hexaline method with its ascending order of semitones no longer requires the use of precessional accidental notation to indicate its accidental pitch positions. The primary difference between the prior art form of the hexaline scoring method of FIG. 17 and the hexaline stacking method of FIG. 19 is that the latter array utilizes sets of eight distinct noteforms to designate the respective twelve-note ranges of each of the eight stacks or octaves. Since each of the respective eight stacks of FIG. 19 has the same cyclic read-out order for ascending relative pitch positioning as the C through C'' uniform order of FIG. 17, the transference of an octavedesignating oval or triangular noteform from any position on any of the eight stacks to a separate singular common stack will logically carry the absolute pitch range of the noteform through to the equivalent relative position on the common stack, thus allowing a full eight octave compass to be graphically represented in terms of a single common stack.

FIG. 20 shows eighteen examples of stemmed oval noteforms on the same relative $F\#/G^b$ space-related pitch position, but in an ascending order of octave pitch representations, and in various time-states. FIGS. 21 and 22 show examples of how single-stack hexaline systems may be utilized to form two-stack systems which parallel the use of upper and lower, or treble and bass systems in the prior art forms using middle-C as a median point of pitch representation. In the described method of pitch representation provided by the use of individualized octave range sysbols as noteforms, a composer writes music in terms of one or two parallel-and-separated stacks, as respectively shown in terms of FIGS. 21 and 22. Whereas the single hexaline stack of FIG. 20 accomodates an eight-octave pitch range, the two-stack methods of FIGS. 21 and 22 are normally used to present a more clear depiction of pitch "handedness" during playout. Generally, an eight-stack or more than a two-stack hexaline array method will not be used for scoring purposes, but only for instructional purposes to explain the operation of the single-stack scoring method and how it bears relation to the graphic referencing method for the score and musical instruments, as will be explained momentarily.

Octave-designating noteforms are then written in either of two ways, and usually in a mutually exclusive way. The primary method is to utilize completely standard noteforms respectively provided with left-facing octave-enumerational stem flags as shown in FIGS. 19,20,21. The second method, used primarily in conjunction with the graphic tactual referencing method to be explained hereinafter, utilizes a repeating series of pointer-directionalized equilateral and isosceles triangular noteforms with or without standard stems as illustrated in FIG. 22. When either set of eight octave-designating noteforms, oval-flagged or triangular, are utilized respectively to show absolute pitch in the relative pitch positions of a single-stack hexaline grid, said noteforms are known as "transoctave notation." Transoctave notation is then read first in terms of the octave range which the note represents, and then in terms of the relative cyclic pitch position it occupies in the common graphic read-out format method of FIG. 17. To retain uniformity of read-out for the transoctave notation, only the lower C position of a hexaline stack is used, with the upper C″ position remaining unoccupied. In the eight-stack system of FIG. 19 and in the two-stack systems of FIGS. 21 and 22, a larger order separation termed the "C-space" is provided between the upper and lower stacks to allow for the introduction of note beams, lyrics and other musical notation (not shown in full detail). Modified treble and bass clefs 188,189 are shown in FIGS. 17 and 21 first to indicate handedness of play, reference pitch positions. The treble clef 188 uses its connective portion within the stack to point to the G pitch line 190 and the bass clef left dot portion outside of the stack 191 is then used to indicate the position of the F-pitched line immediately to the right of said dot 191. The modified key signature format 192 of FIG. 21, and other musical notations will be considered momentarily.

As regards octave-designating or transoctave noteforms, the express purpose of both respective sets of said noteforms is to graphically depict either positive integers from one to four to indicate the respective four octaves above the middle-C reference position in the C-space, or to symbolize negative integers from minus one to minu four to indicate the four respective octaves below the middle-C reference position. The transoctave noteforms utilizing the left-flagged enumerational means are provided with either from one to four left-facing lines drawn at an angle upwards from the standard note stem to graphically represent the first to fourth octave above middle-C; or are provided with from one to four left-facing lines drawn at an angle downwards from the standard stem to represent the first to fourth octave below middle-C. In the preferred embodiment of the left-flagged octave designating means shown in FIGS. 19,20,21, the flag-lines begin initially at the top of the standard stem when the stem is vertically upwards and at the bottom point when positioned vertically downwards, and thence rise or fall in a 60° angle relative to the stem-line, with multiple flag-lines being equivelently lengthed and parallel with the same approximate spacing as the standard form right-facing flags, and with said flag-lines being then closed or boxed in by a vertical connecting line set parallel to the stem line. FIG. 19 illustrates the preceeding description by a presentment of standard note forms in the C-pitched positions for the respective four octaves above and below middle-C with said left-facing flags then enumerating the octaves. FIG. 20 illustrates the said description by a presentment of standard noteforms with stems and enumerational flags along the middle $F\#/G^b$ space-related position of the provided hexaline stack. A stem has been provided for the whole notes 193 which rises in the first case from center top of the whole note and which falls in the second case from the center bottom of the whole note. The respective whole note stems are then provided with four left-facing flags drawn in a downward manner at 60° and set parallel and evenly spaced with respect to each other and closed in by respective vertical lines set parallel to the respective stems, to thus indicate an absolute pitch of $F\#/G^b$ in the fourth octave below middle-C. Similarly, the half-notes 194 utilize a closed three down-flag system to indicate that these are notes from the third octave range down from middle-C and so equivelent musically to an $F\#/G^b$ note position in the octave range of FIG. 19 marked by the three down-flag C-pitched note **194*a*. The quarter-notes 195 with a two down-flag system then represent notes from the $F\#/G^b$ position two octaves below middle-C, and the eighth-notes 196 with one down-flag then indicate $F\#/G^b$ from the first octave below middle-C. Rising in pitch then still further, the sixteenth-notes 197 designate $F\#/G^b$ one octave above middle-C with a flag-line inclined 60° upwards from the top of the stem in the first case and from the bottom of the stem in the other case, both then being musically equivelent notes. The pair of thirty-second notes 198 then designate $F\#/G^b$ in the second octave above middle-C with a two up-flag closed system, and the following sixty-fourth notes 199 then represent the third octave above middle-C with a three up-flag closed system, which $F\#/G^b$ note would then be found in the octave range of FIG. 19 marked by a C-pitched three up-flag closed system 199*a*. Said singularly displayed noteforms are then followed in FIG. 20 by a pair of eighth-notes connective by a beam 200. The first eighth-note 201 displays one up-flag, and the second eighth-note 202 displays two up-flags. This indicates that each is to be played separately as the same $F\#/G^b$ relative pitch, first in the absolute pitch of the first octave above middle-C, and then at the absolute pitch of the second octave above middle-C. The next noteform displayed 203 is an $F\#/G^b$ half-note with four up-flags and one time dot indicating that its absolute pitch is in the fourth octave above middle-C and that its time value is to be increased by one-half. The last note 204** is an eighth-note with four up-flags and two time dots indicating that it is to be played out in terms of the fourth octave range above middle-C with a time value of $\frac{1}{8}+1/16+1/32$.

In FIG. 21 the described preferred transoctave oval-flagged noteforms of FIGS. 19 and 20 are utilized in a two-stack hexaline scoring method to display written music. Wherever it is required that octave-designating noteforms of the same relative pitch but from differing octave ranges or absolute pitches are to be played out simultaneously, this fact will be indicated by a provided connective horizontally elongated "plus" sign 205 between the stems of notes occupying the same relative pitch position in the stack. The same "plus connectiveness" is then utilized to also indicate a simultaneity of playout between differing pitch positions **205*a*** meant for playout in differing octaves.

The triangular transoctave notation system shown in the C-pitched positions of FIG. 19 is used primarily in conjunction with a "linear coded" stack system as shown in FIG. 22. Generally, triangular transoctave notation and the linear coded hexaline scoring format will be presented in a raised print method for a Braille-type of tactual read-out by sightless musicians, as will be explained. The relative pitch displacement value of triangular octave-designating noteforms is initially perceived in terms of the directionalization of the noteform, that is, by means of the pointer-like directions of their respective apexes to indicate with a left direction that the noteform is of an absolute pitch below middle-C, and with a right direction to indicate that the noteform is pitched at or above middle-C. To simplify graphic recognition of the respective triangular noteforms, the first octave above and first octave below middle-C are designated by alternately facing equilateral triangles 206,207, and the second octave above and second octave below middle-C are designated by alternately facing isosceles triangles 208,209. This series then repeats for the third and fourth octave above and below middle-C with the addition of a smaller always darkened equilateral triangle known as a "triangular octave range marker" 210, which is affixed to the respective apex tips of the third and fourth octave forms 211*a*,211*b*,212*a*,212*b*, with said triangular octave range marker then assuming the same pointer directionalization as the noteform to which it is affixed. If required for a fifth or higher or lower octave representation, a second or further enumerating triangular octave range marker is added in the same pointer direction in front of the previous marker or markers, as shown in the upmost C-position 213 in FIG. 19. Similarly, when an oval-flagged form such as shown at 213*a* is to exceed the four octave range from middle-C, an additional flag line is added for each octave. With the exception of 213,213*a* which indicates the highest C on a standard keyboard range, music is generally written within an eight octave compass with middle-C as a mid-reference point for played pitch, 106,106*a*.

Triangular octave range markers are utilized in the eight-stack scoring method of FIG. 19 in the respective C-positions 214 with a base line for each said marker set parallel to the stack lines to thereby indicate by an up or down pointer direction and the respective enumeration of the markers which octave pitch range is being entered into, with the middle-C or C-space position markers resting base to base and so forming a virtual diamond effect 214*a*,214*b*.

All of the triangular noteforms retain the standard method of coding time values into the noteforms, that is, a stemless undarkened noteform as in FIG. 22 215 has the equivelent time value of a standard whole note 193; and an undarkened noteform with a flagless stem 216 is equivelent to a standard half-note value 194; an a darkened noteform with a flagless stem 217 is equivelent to a quarter-note value 195. When flags or beams are on the right side of the stem of a darkened triangular noteform, these are then enumerated in the standard manner to provide the standard time values for eighth notes 218,218*a*, and for sixteenth notes 219, and so forth. It may be seen in FIG. 22 that triangular noteforms may be made stem connective either at their bases or apexes and with one another in point to point, base to base, or point to base connections, to thereby show their temporal connectiveness as notes intended to be played out simultaneously as intervals or chords. Generally, triangular noteforms will be grouped with respect to the standard stem and to each other so that the noteform display avoids triangular closuring which would give a false note status to the closured area. Stem passage through the C-space does not then occur since each stack is a self-contained eight (or more if required) octave system.

Generally, standard forms of musical notation as are used with a pentaline scoring method are also used with the improved hexaline scoring method, that is, time signature formats, rest symbols, bar lines, ties, dots, beams, expression marks, repeat signs, and so on, remain the same. The exceptions to this are the use of clef signs such as are shown in FIG. 18 188*a*,189*a*, ledger lines 220, as well as octave change indicators such as 8*va*, or simultaneity symbols such as Con 8*va*, and key signature formats, as will be explained forthwith. Pentaline staffs require various clef signs such as 188*a*,189*a*, to designate specific pitch orders, but the improved hexaline scoring method displays the same unvarying pitch order of FIG. 17 C through B, and so only utilizes the previously explained modified clef signs 188,189 to indicate general pitch registers above and below middle-C. Ledger lines, octave change indicators, and simultaneity symbols as embodied in the pentaline method have no equivelent meaning in the hexaline method. The ledge lines 220 have the pentaline purpose of extending the five-line staff indefinitely, whereas the hexaline stack cyclically repeats within itself indefinitely. Octave change indicators and simultaneity smybols are approximated but not paralleled in meaning between the two systems of scoring since transoctave notation with its plus connectors 205, 205*a* continuously utilize the essential concepts involved rather than using them as exceptional circumstances for scoring.

As regards the use of a key signature format, whereas it is required in the pentaline system that the composer indicate for playing purposes which natural tones will require sharping or flatting throughout the composition to be played, in the uniform display of the hexaline scoring means, a modified key signature format 192,192*a*,192*b* is used primarily to establish a preliminary "feel" for the composition. The modified key signature 192,192*a*,192*b* may be indicated merely by a letter statement such as for example the C# Minor as C#MN 192 shown in FIG. 21, or be additionally indicated by the introduction of a "key signature cage" 192*a* into the hexaline stack. The key signature cage 192*a* consists of a portion of the hexaline stack enclosed by two bar lines within which are utilized two special forms of "arrow neumes" 192*b*, which are then positioned to point right when they rest upon sharped positions within the stack, and to point to left when they rest upon flatted positions. In FIG. 21 the key signature cage 192*a* has displayed the four sharps 192*b* of the key of C# Minor as C#MN 192, and so has four right-facing arrow neumes 192*b* positioned respectively in the stack spaces for F# and G# and upon the stack lines for C# and D#. If the key signature alters during a composition an interim key signature cage with appropriate arrow neumes and letter display for the new key signature are provided by the same manner of sectioning within the hexaline stack as just described. If no sharps or flats appear in the key, the key signature neumes are omitted with C Major as C MJ or A Minor as A MN written in above the sectioned-in bar line cage. Key signature transposition is accomplished in the pentaline system by rewriting the composition in terms of a new set of sharps, flats and naturals, which can then be simple or difficult as dependent upon the number of separate mechanical alterations required. In the hexaline method, transposition from one key to another only requires that the entire note collection of the composition be moved up or down the required number of semitone intervals (lines and/or spaces of the hexaline stack) between the keys. Since the oval-flagged and triangular noteforms are sequential in octave displacement values, the required transoctave noteforms for the transposition key follow in a simple exchange format.

The operational graphical read-out of the improved hexaline scoring means is performed by mentally rearranging the transoctave noteforms written on the hexaline stack until they are perceived in terms of how they would equivelently appear were they situated in an eight-octave system of read-out. Thus in terms of their immediate perception, one would literally read out the first three notes of FIG. 21 221*a*,221*b*,221*c*, as "A one down" (from middle-C as a reference point), "G# (to comply with the key signature) one down," and "C# one down." Similarly, the beam connective notes 218*a* of FIG. 22 would be literally read out as "C and E one up," and "C and G two up," whereas 219 would be read out as "D# one down," and then "D# and A one up," to comply with the lower to higher octave and then lower to higher relative pitch read-out method. Thus by scanning the displayed noteforms for the lowest displayed octave desigation on the stem along with its lowest displayed relative pitch position on the stem, a proper read-out order is assured. With minimal practice, the score reader learns to read out the sequential order of lower to higher octave and relative pitch values at once for each note in a stem collection as a rote mental operation. That is, with minimal practice the musician learns to comprehensively perceive the connective forms as though they were graphically depicted in terms of the eight-octave compass of ascending pitch presented in terms of FIG. 19. Thus although the improved hexaline scoring method forces a new way of thinking about written music, it nonetheless presents an effective way of optimizing the graphical playout of a musical score in a spatially economical manner.

While the above description of graphic scoring method embodiments contains many specificities, these should not be construed as limitations on the scope of the invention, but rather as an exemplification of several preferred embodiments thereof. Many other variations are possible, for example, the improved hexaline scoring means may alternately be performed in terms of a vertical format. It the hexaline scoring method is to utilize oval-flagged transoctave noteforms, the stacks-may be rotated 90° clockwise and read in a top-to-bottom vertical manner. If the hexaline scoring means utilizes triangular transoctave noteforms, the stacks may be rotated 90° counter-clockwise and read in a bottom-to-top vertical manner. Oval noteforms rotated to the right then show their octave designating flags pointing to the right for up-octaves from middle-C, and to left for down-octaves. Triangular noteforms rotated to the left then show their directionalized pointers pointing up for up-octaves from middle-C, and down for down-octaves. Music written exclusively for a vertically formatted read-out may then utilize alternate methods of presenting lyrics and other written information, for example, by presenting lyrics twice, once in a left-to-right manner through the stack lines before the lyrical expression is to be used, and again vertically in terms of letters and sylables positioned appropriately in allignment with the noteforms which indicate the pitch at which the word portions are to be sung. Alternately, stacking arrays may be arranged to allow a specific stack to indicate vocal scores, as has been done in the horizontally formatted scoring means displayed in FIG. 32 270. And alternately, either hexaline format, horizontal or vertical, may be utilized to provide a charting means for chord displays. More complex chord chart means may alternately be provided such as are typically utilized with the pentaline scoring method, for example, sliding charts presenting chord patterns from the various key signatures and windowed wheel charts. Accordingly, the scope of the invention of a Graphic Music System as it applies to the graphic scoring means embodiments should be determined not by the embodiments illustrated, but by the appended claims and their legal equivelents.

DESCRIPTION AND OPERATION OF THE GRAPHIC REFERENCING METHOD

The Graphic Music System invention contemplates the use of a cooperative graphic referencing method invention acting in a coded manner between the graphic scoring method invention and the keying means of any musical instrument. The coded graphic referencing method comprises viewable color and symbol indicia and tactual indicia for the lines and spaces of the graphic scoring means which correlate with equivelent indicia either marked or labeled directly on said keying means, or indirectly marking said keying means by chart means used in association with said keying means.

In a mono-colored eight-stack hexaline array as illustrated by FIG. 19, the respective stacks have provided thicker lower 222 and upper 223 (C# and B) lines to distinguish these lines from their thinner adjacent lines within the stack (D# F G A). In a single or two-stack array, all lines remain thin. In a mono-colored stacking array, or in a color-coded stacking array, to be explained forthwith, three alternate forms of linear symbol coding may be utilized, as for example in FIG. 22, to visually designate the respective line positions within the stacks. In FIG. 22, the preferred arrangement of linear symbol coding shown has straight lines for the lower 222*a* and upper 223*a* stack lines, brief dash marks for the two middle-line positions 224, and longer dash marks for the two intermediate line positions 225. Linear symbol coding as described, or similar forms of linear symbol coding, may then be presented in a Braille-like raised print manner to afford a tactual means of line position perception for sightless musicians. In a color coded hexaline array, the line positions, whether straight or linear symbol coded, or flat or raised, are further referenced as shown in terms of FIG. 21, by the provision of three alternate color codings for the end, middle and intermediate line pairs so that the lower 222*b* and upper 223*b* lines of the stack will be of one alternate color, the middle lines 224*a* of a second alternate color, and the intermediate lines 225*a* of a third alternate color. The preferred colors are red for the end lines, green for the middle lines and yellow for the intermediate lines, both for their familiar pattern and psychological effect. The described color coded line referencing method for continuous or linear symbol coded stack-line formats may be alternately utilized in a method wherein mono-colored markings for the lines are viewable through a transparent overlayed marking means. More commonly the marking means will be by direct inking or other suitable marking means as dependent upon the medium upon which the score is to be written. It should be noted that once the essential simplicity of the stack line color coding method is clear in mind that the required coloration may be simply mentally projected into a monocolored score for graphic referencing purposes.

Hexaline stack spaces are color coded in a fourth alternate color method of lightly shading the upper, middle and lower spaces 226 of the stack to assist in visual clarification of stack space positions, with the intermediate spaces being left unmarked and white. Alternately, the upper, middle and lower stack spaces 226 may be shaded by means of thin angled parallel lines or cross-hatching methods.

Figures 23, 24, 25, 26, 27:
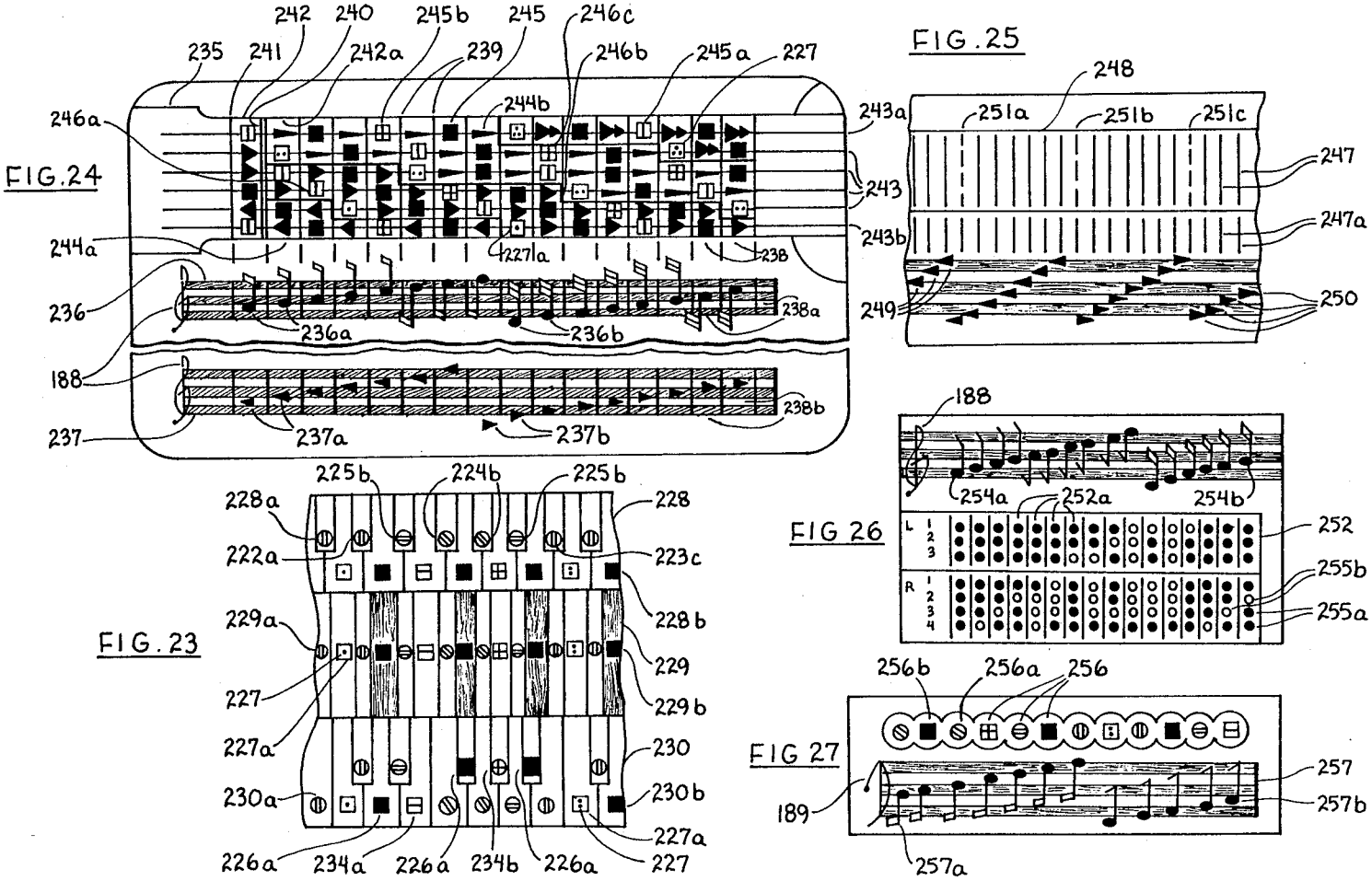
FIG. 23 is a cutaway view of sixteen keying positions in a block diagrammatic chart for a uniform, a graphic and a standard keyboard, respectively, with the graphic keyboard diagram also serving as a vertical hexaline scoring method diagram.
FIG. 24 is a cutaway diagrammatic chart for a guitar fingerboard with cooperative hexaline stack scoring method.
FIG. 25 is a cutaway view of a diagrammatic keying chart for a 46-string harp with cooperative hexaline scoring method.
FIG. 26 is a diagrammatic keying chart for a flute with cooperative hexaline scoring method.
FIG. 27 is a diagrammatic keying chart for timpani with cooperative hexaline scoring method.

Triangular octave range markers 214 such as are shown in FIG. 19 are normally left black, but may be provided in any color and alternately provided in any geometric shape such as the dotted format for range markers 227 illustrated in FIGS. 23,24.

In order to cooperatively utilize the graphically referenced hexaline scoring means with the keying means of a musical instrument, whether in a mono-colored or color-coded method, line-related score positions are designated on said keying means with provided circular or triangular symbols, and space-related score positions are designated on said keying means by provided square symbols, as may be generally observed in FIGS. 23,24,27.

FIG. 23 illustrates a cutaway view of a block diagram chart correlating the keying positions of a uniform keyboard array 228 positioned over and in contact with a graphic keyboard array 229 which is positioned over and in contact with a standard keyboard array 230. It may be noted that the middle equivelent to a block diagram for a hexaline graphic scoring means situated in a vertical read-out format. To demonstrate the graphic equivelence of the graphic referencing method as applied to each of the respective keyboard designs 228,229,230, each of the respective circular line-related position markers, for example **228*a*,229*a*,230*a*, and said square space-related markers, for 228*b*,229*b*,230*b*, have been vertically pitch-alligned so that each of the respective sixteen displayed keying positions in the respective keyboard diagrams may be realized to correlate to the pitch positions above or below. Thus reference made to the circular and square symbols in any of the block diagrams 228,229,230, applies equivelently to each of the two others. Said circular line markers may then be color referenced as were the line-related positions of the scoring means of FIG. 21 in terms of three alternate colors for the end lower 222*c* and end upper 223*c* lines, the middle lines 224*b*, and intermediate lines 225*b*. The square space markers 226*a* may then be shaded in the end and middle positions, thus being equivelent to the shading of the upper, middle and lower spaces 226 of the graphic scoring means, with the square symbols indicating the C positions 227*a* being provided with dotted forms of octave range markings 227, appropriately enumerated from one dot for middle-C to four dots for fourth octave above or below middle-C as determined by viewed position along the length of the respective keyboards. The intermediate square space markers 234*a*,234*b*, may be further referenced by the provision of a minus (−) sign for the lower pitched position 234*a* and a plus (+) sign for the higher pitched position 234*b***. Alternately, the circular and square markers may be provided in a raised symbol coding form, using alternately angled raised striations respectively for the end, middle and intermediate circular marker sets and a differing angle for the square shaded markers and a raised plus or minus sign for the other two square markers.

The preceding description for the viewable and tactual graphaic referencing of the respective keyboards 228,229,230, may be extended to encompass larger portions of the keying surfaces. On various embodiments of the graphic keyboard such as shown in FIGS. 3 and 7, the line and space related keys may be inclined toward the keyboardist at one or both ends to facilitate color coding perception. FIG. 3 119,120, illustrates the use of rear referencing risers whereupon are positioned the said square symbol markers with the color coding referencing method being provided on the viewable surface of the line-related reference risers 120, with a general coloring scheme for the key array being white for the lower case keys 103 and dark gray for the upper case keys 106. In FIG. 7 the same description applies for the reference risers 139,140 and for the general coloring of the key array, with the additional provision of a line-related color coding for the frontal inclined portions **128*a* of the line-related keys 128. In FIGS. 11 and 13*a*–13*b* the equivelent square markings apply, but the color coding has been extended for the length of the line-related keying means 147,151. Linear coded striations done in the manner of FIG. 22 222*a*,223*a*,224,225 are etched or molded into the top length of said line-related keying means 106,128,147, 151, to thereby provide a means of tactual identification for said keys, and as previously stated, to minimize finger slipage during play. Alternately, in lieu of circular markings 228*a*,229*a*,230*a* for the respective keyboard formats, triangular markers may be utilized as will be explained in terms of FIG. 24. When it is inappropriate for whatever reason to mark the respective keyboad arrays 228,229,230 in the manner described whether by actual marks or by labeling means, suitably manufactured forms of paper or plastic chart means may be provided for the respective key array formats wherein the color and symbol coding method described is interpreted directly from the chart and said chart means positioned to the rear of the respective keyboard key array to designate line and space related keys; or, if the chart means is appropriately cut out to correlate with the respective raised key sets of the respective keyboard patterns, then said chart means may be positioned directly upon the key array for the same interpretational use. The respective block diagrammatic patterns 228,229,230** would then serve as appropriate chart means were they suitably directionalized, sized and used as described. Any chromatic keyboard keying means graphically referenced in the manner of the preceding description may then be played out in terms of graphic music means done in either the oval-flagged or triangular transoctave notation system.

The graphic referencing method may then be cooperatively utilized with all other chromatic musical instruments in the same manner of line-position and space-position designation as just described. For example, by combining the two forms of transoctave notation into a consolidated graphic referencing method, it is possible to graphically reference a stringed instrument fingerboard in terms of triangular notational forms representative of line-related keying positions and square forms representative of space-related positions, while playing out said fingerboard keying means in terms of oval-flagged notation. This consolidation of the two noteform systems is exemplified in FIG. 24 which shows a cutaway view of a diagrammatic keying chart for a guitar fingerboard 235 positioned in a horizontal manner over a cooperative hexaline stack 236 scored in oval-flagged noteforms **236*a*,236*b*, which are then together positioned horizontally over a second cooperative hexaline stack 237 in a lower cutaway view of the bottom portion of the keying chart of FIG. 24 which is scored in terms of stemless triangular noteform symbols 237*a*,237*b*. Sixteen vertical columns 238 are illustrated in the fingerboard keying chart which are produced by extending the fret lines 239 and guitar nut line 240 downward, and then adding an additional vertical line 241 at the left end to enclose the open string position 242, with all said vertical lines then extended downward and appearing on the respective stacks 236,237 of the chart to segment the stacks into sections 238*a*,238*b*, for recording therein the respective oval-flagged and triangular notational forms which correspond to the stack fret positions in the respective downward (to right in the diagram for the fingerboard 235) linear orders of the strings 243,243***a*,243*b* in their respective fret columns 238*a*,238*b*. Said strings are indicated on the guitar diagram 235 by horizontal dashed lines beginning at the left tuning end and passing through the fret lines 239 to the right strumming end. In reduction to practice, if the guitar or other fingerboarded instrument is to be marked in accordance with the chart means of FIG. 24, the open string positions 242 would ordinarily be displayed in a double vertical column within the fingering area of the first fret position 242*a*. The top single stack 236 with the oval notation 236*a*,236*b* then corresponds to the first or treble E string 243*a* of the guitar 235 and has double up-flagged or second-octave-above-middle-C notes 236*a* in the first nine fret positions, which are followed by triple up-flagged or third-octave-above-middle-C notes 236*b* in the next seven fret positions. In order to simplify the understanding of the graphic scoring and referencing method, the musical notes of the keying chart of FIG. 24 have been written in the customary manner of writing guitar music one octave higher than the usual tuning of the instrument. In fact, since a single hexaline stack may display an eight octave compass, the guitar musical notes could be presented at their absolute pitch. Thus, written one octave higher than their absolute pitch, the first eight positions of the lower treble marked single hexaline stack 237 have been presented in stemless triangular noteform symbols 237*a* for the first octave below middle-C, which then corresponds to the first eight fret positions of the lower or sixth string of the guitar 235. The following eight fret positions have been written on the stack 237 using first-octave-above-middle-C stemless triangular noteform symbols 237*b*.

As stated, the guitar fingerboard 235 generally, has been graphically referenced in terms of stemless triangular noteforms and square forms. More specifically, the stemless triangular noteforms 244 have been displayed in the guitar diagram to point out the direction of the octave range which they are entering, and are pointed to the left 244*a* when entering octaves below middle-C, and to the right 244*b* entering octaves above middle-C 227*a*. Each triangular noteform displayed for the graphic referencing of the fingerboard is then of the same octave range designation form as the particular fret position in which it is displayed, and so correlates with the hexaline scoring means, for example, as the aforementioned sixth string 243*b* correlates with the written notes on the lower stack 237, with both stack and fingerboard representation being done in the chart of FIG. 24 at one octave higher than absolute pitch. The square space-related forms displayed on the fingerboard have then been marked in the manner described for the square symbol forms of FIG. 23, that is, in terms of a dot octave ranging enumeration method for the C positions, for example, 227,227*a*; and with a two end and middle space shading method 245; and with a lower pitch minus symbol 245*a* and upper pitch plus symbol 245*b* marking method, all of which methods then may also be presented in a raised symbol format along with the said triangular line-related symbols for tactual identification purposes.

Further octave ranging is then done by providing three alternate lines 246*a*,246*b*,246*c*, each of which respectively outlines the pitch range for the respective four octaves entered into in the compass of a fifteen fret guitar such as shown in FIG. 23 235. Areas within the respective outlines (and the outer edge lines of the guitar 235) then only contain octaval pitch values, and thus the specific triangular noteforms of a specific octave range. Normally, the line-related pitch values displayed upon a fingerboard chart will be done in the triangular noteforms shown to facilitate a simplified graphic recognition of the relative positioning of the respectively pitched fret positions (or unfretted fingering positions) as these then correlate to the displayed noteform positions on a graphic scoring means. Alternately, other symbol forms for line or space related positions on the fingerboad may be used for the same effect, for example, block form symbols of closed flag-on-stem octave ranging designators, or alternately, block form symbols of hexaline sections with oval noteforms displayed thereupon may be used. As an alternate format to the mono-colored display of FIG. 24, the line and or space related symbols designating hexaline scoring means positions may be color coded in the same manner as the score-to-keyboard color coding method described for FIG. 23, that is, in terms of three alternate colors for the respective end, intermediate and middle line-related positions, with a fourth alternate color for the upper, middle and lower space positions.

The descriptions provided for fretted fingerboards as exemplified by the guitar graphic referencing means of FIG. 24 would then apply equivelently to fretless fingerboard embodiments such as would be found on a violin or cello, with the required graphic referencing means markings then being displayed on the fretless fingerboard in the appropriate pitch fingering positions, and with the equivelent diagrammatic chart methods of FIG. 24 then utilizing vertical columns centered on such fingering positions extended to provide a sectioning means for a hexaline scoring means with the appropriate noteforms written thereupon.

The hexaline graphic scoring method may also be referentially utilized with a stringed instrument such as a harp in the manner illustrated by FIG. 25 which shows a cutaway view of a 46-string harp keying chart. The harp strings 247 have been set into a block diagram context 248 and are positioned over a diatonically scaled hexaline stack 249 with vertical extension lines 247*a* indicating the respective string-to-note pitch equivelency with stemless triangular noteforms 250 written upon the stack lines and spaces where the string extensions 247*a* would intersect if further extended. Since the tonal range of the modern harp encompasses six and one-half octaves, and since the harp is commonly tuned in one key which may be transposed to two other keys by means of foot pedals, three different keying chart stacks would be required for each first tuning choice of tonic key, as in FIG. 25 the displayed stack shows a diatonic tuning to C Major. Since harp strings are manufactured in two traditional color coding methods being first, C-red; F-purple; D E G A and B-white, or, alternately, C-green; F-purple; D E G A and B-red, utilization of the cyclic order of the hexaline graphic scoring method 249,250 only requires that the harpist associate recurring pitch positions on the stack with recurring color positions on the strings 247. As an improvement to the harp string color coding method, the strings 247 could be manufactured utilizing the color pattern of their basic scale color coded pitch equivelents on the stack lines and spaces, that is, in terms of the previously stated color preferences for the graphic keyboard and graphic scoring means taken in a diatonic context of C-white D-dark gray E-white F-green G-green A-yellow B-red, with the added provision of an octave range coding method for the C positions 251*a*,251*b*,251*c* consisting of brief dash-like red markings (indicated by the dashed C position strings in the string array of 247) on the white C position strings along the sight area of the string array 247 just above the normal fingering area. Said color coded octave range markings would then be longer for the middle-C position 251*b* and become successively briefer for each octave C position 251*a*,251*c* removed from middle-C 251*b*. Such markings and color codings as just described would then appear in the keying chart string array 247,248 in lieu of the more conventional color coding methods.

The graphic scoring and referencing methods may also be cooperatively utilized with a wind operated musical instrument such as a sixteen tone flute in the manner illustrated by FIG. 26 which shows a keying chart for a flute's hole positions 252 displayed beneath a single hexaline scoring means 253, upon which is further displayed sixteen oval-flagged noteforms ranging from D above middle-C 254*a* to F in the third octave above middle-C 254*b*. The sixteen vertical column 252*a* below the respective transoctave noteforms on the stack 253 then indicate the proper fingering positions for the said notes by means of darkened circles 255*a* which are representative of holes to be covered, and by means of undarkened circles 255*b*, which are representative of holes to be left uncovered. Positions to be closed by the left first three fingers are indicated by the "L 123" symbols which then correspond horizontally to rows of circles 255*a*,255*b* across the vertical columns 252*a*. Positions to be closed by the right first four fingers are then indicated by the "R 1234" symbols which have an equivelent correspondence to the lower four horizontal rows of circles 255*a*,255*b* across the vertical columns 252*a*. The modified treble staff 188 is used in FIG. 26. Octavally related line and space position color coding would be as for FIG. 23.

The graphic scoring and referencing methods may also be cooperatively utilized with percussive instruments such as tuned timpani in the manner illustrated by FIG. 27 which shows a keying chart for tuned timpani wherein each timpani is diagrammatically shown as a circle 256 bearing either a smaller circle 256*a* for indication of a line-related tuning position, or a smaller square 256*b* for indication of a space-related tuning position. Said diagrammatic timpani 256 are then shown positioned over a hexaline stack 257 marked by a modified bass clef 189 which then displays a one-octave tuning range from F in the second octave below middle-C 257*a* through E in the first octave below middle-C 257*b*. In use, the line and space order of the tuned timpani 256 would be symbolized on the top viewable surface of the stretched membrane of said timpani 256 by use of pressure-sensitive labeling means displaying the described temporarily required symbols, then color coded in the typical manner exemplified in the previously described keying charts of FIGS. 23,24. Although timpani are normally limited in number as to only require perhaps three actual labels such as just described, the principles of the Graphic Music System are nonetheless exemplified in FIG. 27 so that were it required that one be able to easily graphically differentiate the pitch value of one timpani in a dozen the means suggested would be reasonable and useful.

Whereas the marking means for the graphic referencing method for the various chart means used in association with musical instruments and exemplified by FIGS. 23,24,25,26,27, would typically consist of a colored printing process, the marking means for the various directly marked instruments such as the keyboard or fingerboard would typically be dyed or inked directly into said keyboard or fingerboard in the flat or raised portions corresponding to the graphic referencing method, or otherwise provided by suitable coloring means such as printed color adhesive lables of paper or plastic, or by plastic laminates.

It should be understood from the various preceding descriptions of the graphic scoring and referencing methods that all classes of chromatic musical instruments may be suitably referenced and played utilizing graphically scored and referenced music, since the music indicated is mathematically equivelent in all respects to traditionally written music. Thus while the preceding description of graphic referencing embodiments contains many specificities, these should not be construed as limitations upon the scope of the invention, but rather as an exemplification of several preferred embodiments thereof. Many other variations are possible, for example, the improved graphic referencing method may have the graphic scoring means and instrument keying means referenced in alternate flat or raised symbol sequences such as would equivelently duplicate the octave designating methods of the given oval-flagged and triangular transoctave noteforms, and so effectively duplicate the operative methods of the invention. Alternately, other graphic referencing means such as would utilize various lighting methods or electrovisual displays set forth in equivelent coding methods could be utilized within or adjacent to the graphic score or keying means to graphically reference each to the other. Alternately, tactual recognition of the line and space related keys of a graphically referenced keyboard may be facilitated by the provision of electrostimuli set into the substance of the respective keys as would then provide vibrational or thermally coded identifiers to generate a graphic marker imaging means. And alternately, standard keyboard coloration patterns of two alternate colors for the lower and upper case key positions may be transferred to a graphic keyboard pattern to provide a means whereby traditional pentaline music may be more effectively played out thereupon. Accordingly, the scope of the invention of a Graphic Music System as it applies to the graphic referencing means embodiments should be determined not by the embodiments illustrated, but by the appended claims and their legal equivelents.

DESCRIPTION AND OPERATION OF GRAPHIC CONVERSION AND WRITE-OUT METHODS

In order to provide graphic music playable in the unitive context of the invention of a Graphic Music System, hexaline scored music such as has been described must either be newly composed and written out in terms of the transoctave noteform methods previously described, or must be converted from existing music and also written out in terms of the said transoctave noteforms. Whereas it is obvious that Uniform Music System music may be directly translated into graphic music by transforming its standard notational forms into transoctave noteforms and placing these into the context of one or two hexaline stacks, the actual norm of written music is pentaline scored Standard Music System music, which is more difficult to convert into graphic music. It is thus an important element of the invention of a Graphic Music System to provide a relatively simple means by which standard pentaline music may be converted into the graphic hexaline format and written out in the required transoctave notational manner.

Figure 29:
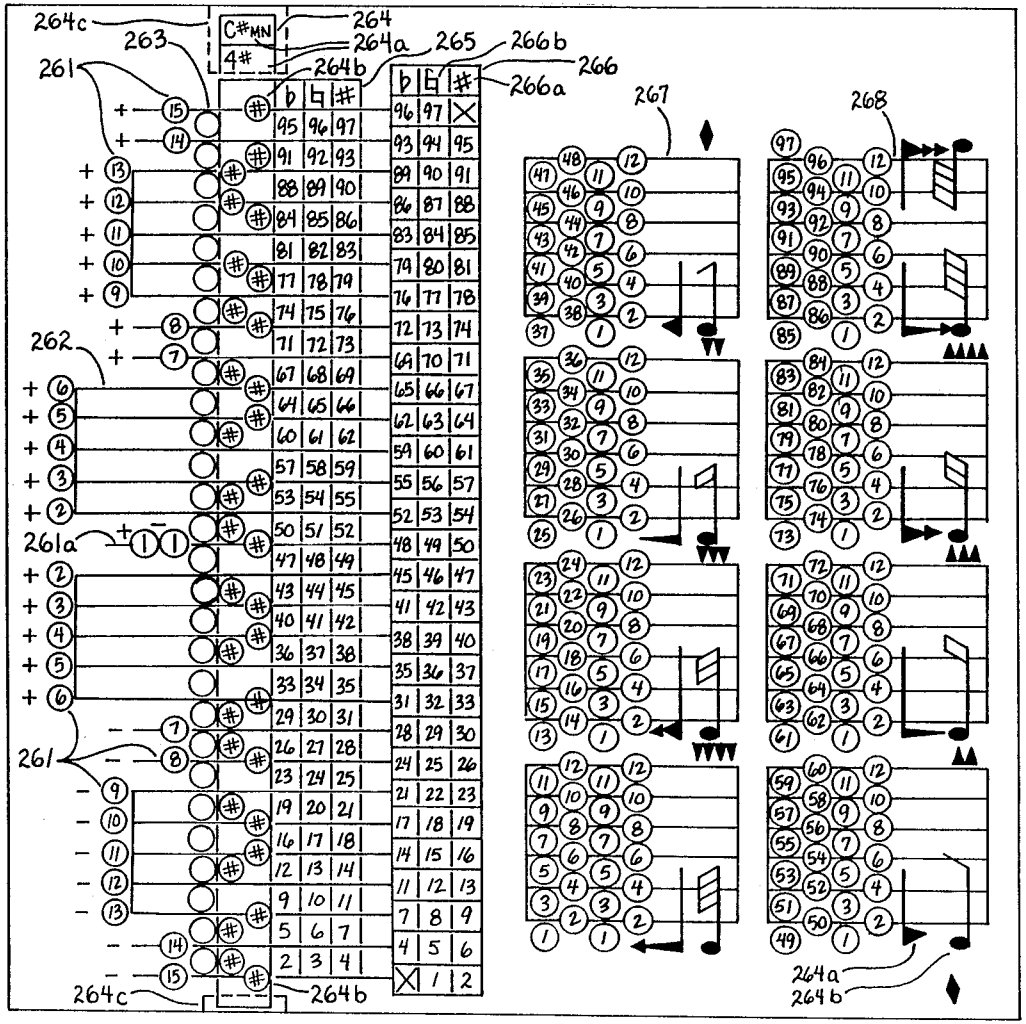
FIG. 29 is a face view of a score conversion table chart.
Figure 28:
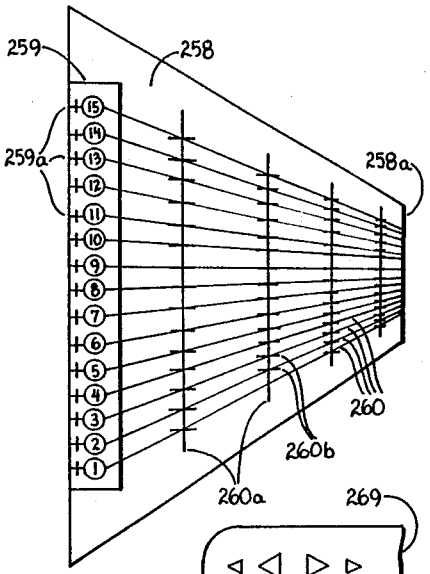
FIG. 28 is a front plan view of a plastic score converter template.

As previously stated, pentaline music is generally written within an eight-octave compass which then consists of ninety-seven distinct pitch positions for naturals and accidentals, that is, eight times the respective twelve notes in each C tonic octave plus a ninth highest C position, in terms of twenty-nine lines and thirty spaces as was shown in FIG. 18. Hexaline graphic scored music, as exemplified by FIG. 19, is then also written in terms of ninety-seven distinct pitch positions in an eight octave compass in terms of forty-eight lines and forty-nine spaces, and in a manner wherein the respective octaves are visably distinguishable from each other in the previously described eight-stack arrangement, and in a method which allows each respective C tonic octave range in the eight octave compass to display its own specific transoctave notational form designating that twelve note range, so that upon transposing such octave-designating noteforms to a single hexaline stack, the relative C through B positioning may be utilized to score an eight octave range, as exemplified in part by FIGS. 20,21,22. Thus the initial object of the score conversion process, as will be explained in terms of FIGS. 28,29 is to determine what the "1-97" numerical pitch level is for each of the pentaline scored notes to be converted as taken from a bottom C position as "1" and a top C position as "97", also then taking into account various factors affecting pentaline note pitch read-out such as the given key signature of the pentaline composition to be converted, and any given accidental notation and octave altering notation (such as **8*va*), so that the derived pentaline numerical pitch position value may be equivelently applied to a hexaline eight-stack system with a bottom C position of "1" and a top C position value of "97" as illustrated in the conversion chart of FIG. 29, to obtain therefrom both the required "1-8" triangular or oval-flagged octave-designating noteforms and the "1-12" C to B relative pitch position for the obtained noteform when said noteform is placed in a single hexaline stack context of note display. The next object of the score conversion process is to provide each of the derived transoctave noteforms with a time value display equivelent to the pentaline time value display, that is with one of the basic "1-7" possible time states for the noteform, plus any observed dot, dots, or ties. Once the basic pitch/time value of each pentaline note is successively obtained and transformed through to the graphic scoring means, the remaining standard notation and converted key signature format (previously exemplified in FIG. 21 192,192*a*, 192*b*) may be carried through and written out on the hexaline format, that is, modified clef signs (previously exemplified in FIG. 21 188,189**), identical time signature, bar lines, rests, phrasing, lyrics, and so forth, as would be required to effectively produce a graphic hexaline score musically equivelent to the source pentaline composition.

Whereas the time value of a pentaline source note is obvious and is carried through to the hexaline stack in an obvious manner as previously described in terms of FIG. 20, the equivelent "1-97" pitch value enumeration must be obtained by a process of calculation. This calculation of "1-97" numerical pitch value may then occur by one of several means. After observing said factors affecting pentaline source note pitch read-out, one may initiate a manual count of note positions using middle-C as a reference "49th" position and then transpose the results of the count to an eight-octave hexaline stack array such as shown in FIG. 19 initiating the count with the "49th" or middle-C position, or alternately, one may utilize a physical enumeration means such as is exemplified by the "template and chart" method of FIG. 28,29, or, alternately, via an electronic enumeration means such as is exemplified by the flowchart and electrovisual image of FIGS. 31,32, both of which methods will be discussed forthwith.

FIGS. 28 and 29 respectively show a clear plastic template with markings set thereupon, and a printed numerical conversion chart of paper or plastic, both of which are used cooperatively to obtain the basic conversion data, that is, equivelent hexaline octave range noteforms and relative stack positions in terms of numerical values from source pentaline scored notes. The transparent plastic template 258 of FIG. 28 is manufactured in the form of a flat truncated **258*a* equilateral triangle, and read with its truncated end 258*a* to the right. Adjacent to the left edge of the template 258 is a rectangular area 259 containing a printed register of numbers 259*a* on both the displayed side and on the reverse side of the template 258. On the side shown, the vertical register of numbers 259*a* are respectively written within circles and ranging from a bottom "+1" to a top "+15". On the side not shown, the vertical register of numbers (to the rear of 259*a*) are respectively written within circles and ranging from a bottom "−15" to a top "−1". Each of the two sets of circles with numbers 259*a* on either side of the template 258 is connective respectively with one of a series of angled lines 260 which are drawn to the right of the respective circles and terminate at the edge of the right truncated end 258*a* of the template 258 so that equivelently diminishing distances occur between the angled lines 260 from the numbered left end 259*a* to the truncated right end 258*a*. Several vertical referencing lines 260*a* are then provided which are parallel to the left and right template edges and which pass through the angled line system 260 to mark off respective equivelently distanced spacings at the points of intersection between the vertical referencing lines 260*a* and the angles lines 260. Said points of intersection are then marked by equivelently lengthed dash-like lines 260*b* which are provided perpendicular to and bisected by the vertical referencing lines 260*a*. In use, the template of FIG. 28 is placed over the written notes of a pentaline score means such as is exemplified by the hard copy of FIG. 18, and by the electrovisual imaging means of FIG. 32 273 and used to assign each pentaline source note thereupon with a temporary "−15" to "+15" reference number obtained by vertically and horizontally referencing the template 258 to the pentaline score middle-C position for the staff being converted and utilizing the "+1" to "+15" side to enumerate ascending pitch sequences in the pentaline treble staff and the "−1" to "−15" side to enumerate decending pitch sequences in the pentaline bass staff. Thus as the template 258 is referenced to middle-C in terms of the "−1/+1" positions, said template is laterally positioned so that only the vertical reference line 260*a* and dash-line system 260*b* which approximates the actual spacing distances of the pentaline score being converted is used. At this point, the vertical reference line 260a will be superposed over the vertical position of the source pentaline note with its dash-line system 260b superposed over the staff and ledger lines of said pentaline score. The pentaline notes are then read through the clear plastic portion of the template 258 and followed through the angled lines 260 to the left numbered end 259a to obtain therefrom the proper line-reference numbers for the note being converted. If the pentaline source note is a space-related position then the adjacent set of line-reference position numbers are used to temporarily reference the space-position as lying between those two values. Once the temporary reference number 259a has been obtained through the described use of the template 258, said obtained number is carried over to the table chart of FIG. 29** for translation into the "1-97" pitch value, "1-8" octave noteform, and "1-14" stack position values in the following manner.

The table chart of FIG. 29 has provided a series of first vertical columns 261 of circles pentaline line-related numbers set to the left of a twenty-nine line and thirty space pentaline staff grid 262. Said line-related nubmers 261 correlate with the template 258 numbering system 259a and range from "−15" through "+15", with middle-C 261a as "−1/+1". The second vertical column of empty circles within the pentaline grid spaces 263 represent space-related natural tone positions on a pentaline staff system 262, and remain empty for a more clear interpretation of said space positions in terms of the adjacent upper and lower line-related reference numbers. A third provided rectangularly enclosed vertical column at 264 is produced by overlaying a "key signature strip" 264 to obtain the proper positions for sharps (#) 264b and flats ($^b$) as are indicated in the key signature 264a of the pentaline composition undergoing conversion. In the displayed key signature strip 264 of FIG. 29, the key of C# Minor (C#Mn) 264a is being presented, and the four sharps of the key signature, C# D# F# G#, are respectively shown in all of their required positions 264bThe unshown reverse side of the key signature strip 264 has then imprinted on its top opague portion 264a the equivelent four sharped key signature of E Major to reduce the number of required strips to cover the full range of key signatures.

Once a template obtained, or otherwise obtained temporary "−15" to "+15" numerical reference value, say "+3" for a pentaline scored G note, is carried over to the first chart column 261, said "+3" position is located in said column and the line-related position traced horizontally to the right and the observed key signature sharping value from the second columnn key signature strip 264b is taken into account as the line is further traced to the right past the fourth rectangularly enclosed triple-arrayed sharp/natural/flat column 265 for space-related pentaline position numbers from "2-97" to reach the fifth vertical rectangularly enclosed triple-arrayed sharp/natural/flat column 266 displaying line-related pentaline position numbers ranging from "1-97", and thence to the right vertical array 266a marked at its top position with a sharp (#) and box-valued along said trace line at "57". The pentaline pitch value enumeration "57" is then carried past the sixth vertical column 267 displaying the lower four octaves of an eight octave hexaline stacking array to the seventh vertical column 268 displaying the upper four octaves of an eight octave hexaline stacking array where the number "57" is located in the encircled "9th" space position of a hexaline stack marked in its lower C position by one-octave-above-middle-C triangular and oval-flagged transoctave noteforms 268a,268b as a G# relative hexaline stack position.

The respective key signature strips 264 are manufactured of thin clear plastic with appropriately positioned sharp 264b or flat symbols imprinted thereon within note-like circles for proper covering of the appropriate line and space positions on the pentaline grid 262. Said key signature strips 264 may then be kept separate from the table chart and affixed thereupon when required by means of clear plastic clips 264c shown in dotted outlines at the top and bottom of the key signature strip 264, which are then suitably attached to or molded into the substance of the table chart of FIG. 29. Alternately, said reversible key signature strips may be provided with a suitable "feeler gauge" type of end-aperture and pivotal hinging mounting means whereby each of the required strips may be rotated from a horizontal to a vertical position as required and clipped at its bottom portion by the described method of 264c. If the key signature of the pentaline composition being converted is C Major or A Minor wherein no implied accidentals appear, and if no accidental notation is applied to the template covered pentaline source note, then only natural marked 266b fourth and fifth vertical column positions will be utilized. Wherever the template covered pentaline source note has either a key signature implied accidental sign, or accidental notation directly preceding it, or implied within the pentaline measure being converted, said accidental value for flatting, naturalization, or sharping said source note will then be carried through to the appropriately marked vertical colum 265,266 array column for accurate conversion.

Figure 30:
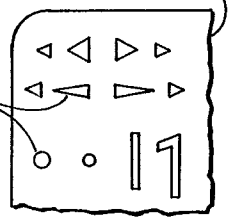
FIG. 30 is a cutaway front plan view of a writing template.
Figure 32:
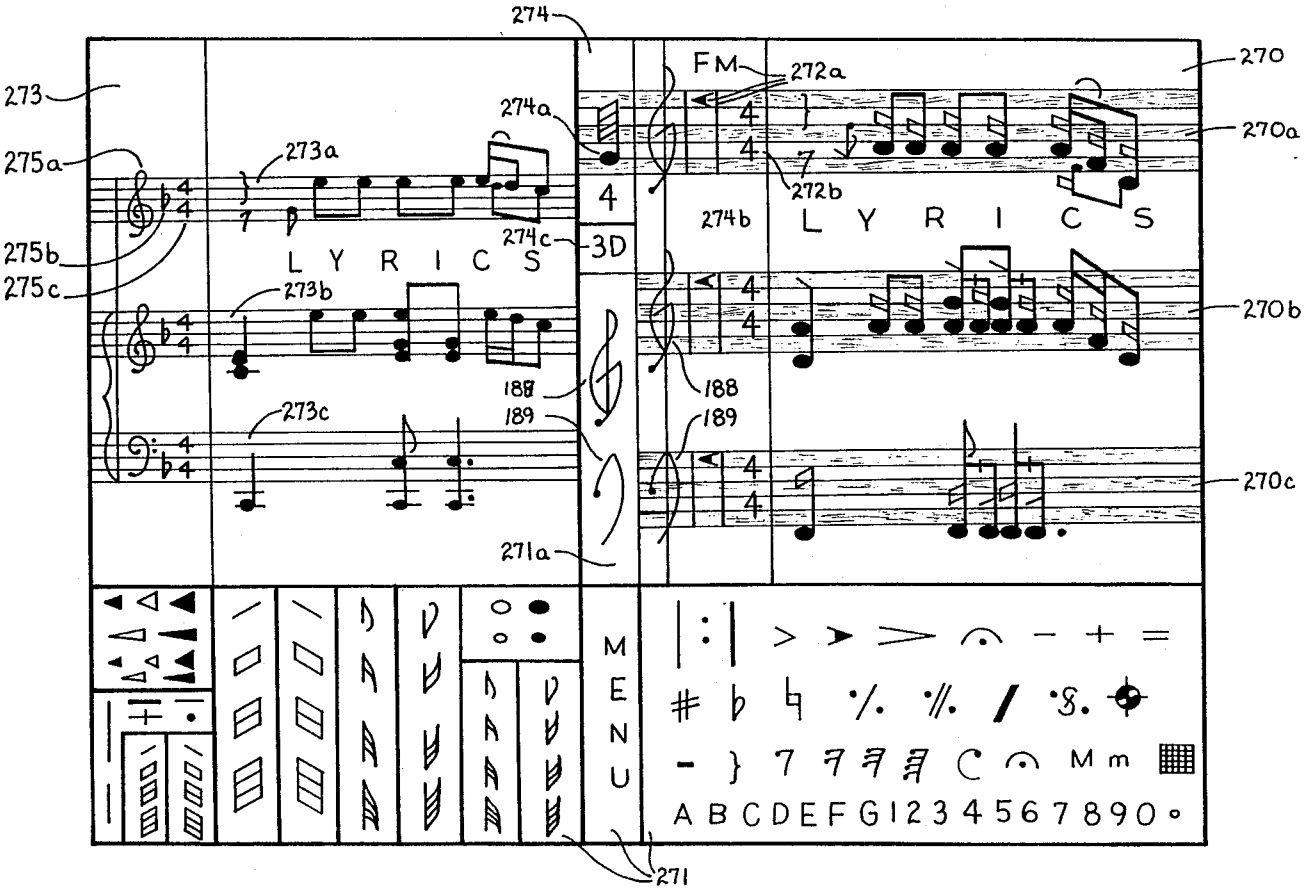
FIG. 32 is a front plan view of an electrovisual image for the score conversion and score write programs.

Once the hexaline pitch value for a source note has been obtained in the manner just described, and the time value observed for the source note, the composited pitch/time value may then be hand-written out on a hexaline stack in either the triangular or oval-flagged transoctave notation method. To write out a hexaline score, manually prepared or pre-printed hexaline music sheets with blank hexaline stacks separated by a minimum of a one stack height spacing distance may be utilized to hand-write the selected noteforms in their proper pitch/time valued positions on said stacks. Alternately, a drafting-type thin plastic template 269 as shown in FIG. 30 in a cutaway view, may be utilized with cut-outs provided for the various graphic and standard musical symbols 269a required to effectively produce the overall hexaline notational requirements. Since much of pentaline music is written in terms of an added upper treble staff for vocal scoring, as illustrated in FIG. 32 273 the blank pre-printed scoring means may be written in terms of a three-stack system of double-treble and single bass stacks, as exemplified in FIG. 32 270. Preferably, the newly converted stem-connective triangular noteforms would first be written out using an erasable medium to test for accuracy of display and the avoidance of closuring lines which would give a false note status to the converted music.

In addition to the template and chart score conversion method just described, alternate plastic template means may be used whose operative means relies on provided guide lines drawn between the twenty-nine lines and thirty space pitch positions of the eight octave pentaline staff system and a larger order vertical column with ninety-seven dot-marked positions, from which dot-positions a second set of ninety-seven guide lines extends to the opposite side of said vertical dot-marked column terminating respectively with the ninety-seven pitch levels of an eight-stack hexaline array so that a pentaline natural source note matched against the pentaline edge of the template will output at the opposite hexaline edge of the template as a "1-97" natural note value. Similar key signature strips as described for use with the table chart of FIG. 29 264 applied to the pentaline edge of the said template would then permit an interpretation of implied accidental positions, in which case, as in the case of other required accidentals, the proper hexaline pitch position would be obtained by moving up one semitone dot position for a sharped value, and down one semitone dot position for a flatted value in the middle "1-97" dot-position vertical column before outputting along the guide line toward the hexaline eight-stack array. Alternately, a similar guideline pentaline pitch to hexaline pitch template score conversion means could be achieved by utilizing a rotatable connection line means positioned so that one of its end lengths will pass through the pentaline note to be converted and its other end length will pass across the inverted enumeration of the "1-97" pitch values to provide a hexaline note value from the pentaline note value which may then be applied to a table chart means equivelent to the vertical columns 267,268 in the table chart of FIG. 29.

Figure 31:
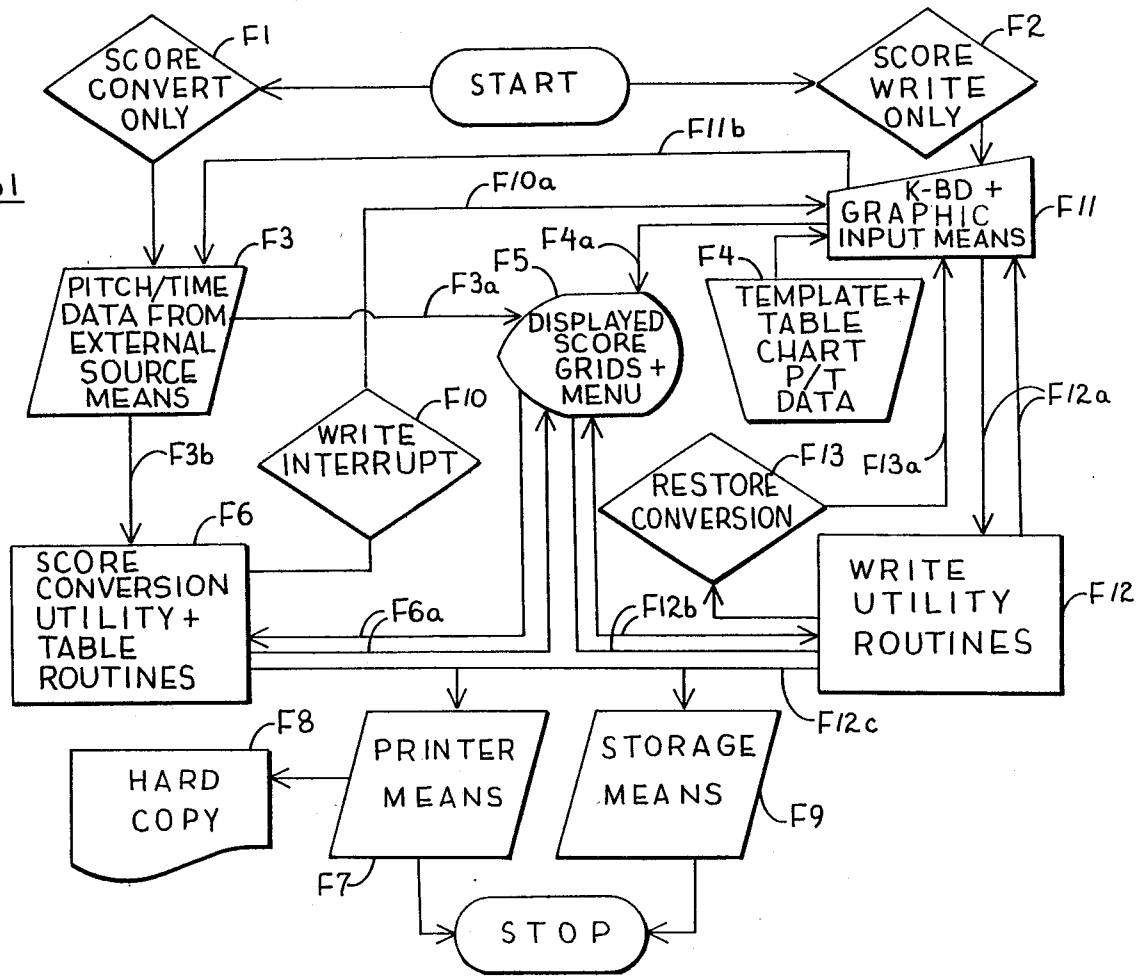
FIG. 31 is a diagrammatic flowchart algorithm for computer assisted score conversion and score write programs.

The template and table chart score conversion means thus far described may be alternately utilized with various levels of computer assistence as would be provided by alternate "convert/write programs" to be developed in accordance with the generalized convert/write flowchart algorithm of FIG. 31. Said convert/write programs would be initialized with a choice to "Score Convert Only?" F1 or to "Score Write Only?" F2. If the choice is to score convert only in terms of the template and chart score conversion means, the "Score Write Only" F2 option will be taken and the "Keyboard and Graphics Input Means" F11 will be instructing the "Pitch/Time Data From External Source Means" F3 via **F11*b* to transmsit via F3*a* the digitized output of a pentaline score taken from an optically or magnetically scanned pentaline hard copy to the "Displayed Score Grids and Menu" F5, with said digitized score then appearing on the video display means F5 in a manner such is shown in FIG. 32 273. Said pentaline score image 273 would then be scrollable by control means within the said keyboard means F11 and provide an image means whereby the template converter means of FIG. 28 258 may be utilized directly against the screen image F5 to obtain the proper said reference enumeration of pentaline line and space positions "−15/+15" for further use with said table chart conversion means of FIG. 29, then positioned external to or made a part of the on-screen display image means F5, to then provide the required "1-8" noteform and "1-12" relative position data required to construct the equivelent hexaline notes by the menu write method to be described in terms of "Template and Table Chart Pitch/time Data" F4 manually entered upon the displayed score grid F5 via the keyboard or graphic input means F11. Once scrollably written on said displayed score grid, the converted pentaline to hexaline score may be transmitted through the "Write Utility Routines" F12,F12*c*to a "Printer Means" F7 for a "Hard Copy" F8 of the newly written hexaline score, or transmitted into an external "Storage Means" F9**, such as a floppy disk and disk drive system for later use.

At a next higher level of processing, said digitized pentaline score may be pitch enumerated in the described "−15/+15" method of template 258 to screen image F5,273, but with said enumerations being manually entered by keyboard means F11 via **F11*b* to be pitch data from an external source F3 transmitted via F3*b* for processing by subroutines in the "Score Conversion Utility and Table Routines" F6 to derive a "1-8" noteform outline sans time value in the proper "1-12" stack position in an on-screen window such as shown in FIG. 32 274, or as a "1-8"/"1-12" numerical equivelent of said noteform as in the lower window 274*b*, both then in terms of the screen display F5 via F6*a***.

At a next higher level of processing, said digitized pentaline score may be pitch enumerated by subroutine programming F6 which permits the keyboard or graphics input means F11 (such as a light pen extension via **F4*a*) to cursor or to otherwise enumerate said "−15/+15" pentaline line positions, then processing said enumerations by said utility and table subroutines F6 via F6*a*, thence providing non-time valued noteforms or their numerical equivelents on the display means F5 as just described. Vertical cursor movements in such a program would enumerate the said reference numbers "−15/+15" with a "−0.5/+0.5" median reference value given to pentaline space-positioned pitch levels after user-allowance for affecting factors such as accidentals and octave-altering notation, etc. For example, a user-derived reference number and symbol value such as "−14.5 #" derived by cursor counting or other measurational means would be entered via the input means F11 and be processed through table routines F6 and passed to the display means F5 to provide an on-screen display of "4" (at 274*b*) from the equivelency in the "1-97" pitch levels of the eight-octave compass, and/or further process this through table routines F6 to provide an on-screen display (at 274) of an outlined image of a fourth-octave-below-middle-C triangular or oval-flagged noteform 274*a* in the D#/E$^b$ hexaline line position of the hexaline stack sectioned window 274. Said displayed noteform 274*a* may then be written out on the screen display means 270, as will be explained, after user-observation of its time value and any required beam connections and required clef positioning on the stacks of 270, 270*a*,270*b*, 270*c***.

At the next higher level of score conversion processing, initiated with "Score Convert Only "" F1, and with a constant access to a "Write Interrupt" **F10,F10*a* for required editing, the hard copy image of a pentaline score would be digitized as described and entered into the program routines F3 for fully automated score conversion processing by the utility and table routines F6 to provide from said digitized pentaline score a musically equivelent hexaline graphic formatted score in a process of automatic on-screen write-out, as for example, FIG. 32 shows pentaline music written on the pentaline staff images 273*a*,273*b*,273*c*, and converted equivelent hexaline graphic music written on said hexaline stack images 270*a*,270*b*,270*c***.

Said automated convert/write computer program as would be developed from the general flowchart algorithm of FIG. 31 would initially prepare the digitized hard-copy pentaline score image to the dimensions shown for the on-screen image of FIG. 32 273 and initiate the conversion process by using subroutines to search for clef **275*a*, key signature 275*b*, and time signature 275*c*, to identify these both for score carry-over purposes and for accurate read-out of the pitch/time values appearing sequentially and similtaneously until the appearance of the next clef, key signature and time signature elements in the digitized pentaline composition being converted. Said automated program would then search out the next nearest vertical sign such as a bar line, and then retrace the search to locate the pitch-/time values for the pentaline notes within the vertical bar lines, counting each in the described "−15/+15" method and processing said enumerations through table search routines to provide the equivelent hexaline graphic data and measuring the proper lateral separation spaces and required positionings to allow the hexaline composition 270 to appear spatially balanced on the scrolling three-stack display 270***a*, 270*b*,270*c*. Said automated program would then also search for octave-altering notation, ties, slurs, and so on to effectively produce a digitized hexaline graphic score musically equivelent to the entered pentaline score 273 as a digitized record for storage F9 or print-out F7 as a hard-copy F8.

Whereas said automated convert/write program would obtain the pitch value of the respective pentaline notes primarily by counting methods such as described, pentaline times values would require detailed subroutine analysis for affecting factors such as emptiness or darkness, stem or no-stem, flag or no-flag, beam or no-beam, dot(s) or no-dot(s), sequential-only or simultaneously-appearing, and with a proper hexaline stack address to carry the composited digitized noteform data through to the proper stack for an accurate automatic write-out. The write-interrupt F10 provision would then be utilized whenever the previously described more fully automated program for score conversion failed to provide a proper read-out and so write-out, as would be interpreted through electronic playout of the automatically written score by said computer conversion into electronic sounds or by suitable checking methods. The write utility routines F12 would via F12*a*,F12*b* be utilized for editing purposes to provide a more balanced appearance for the hexaline graphic score 270, and the "Restore Conversion" F13 option via F12*a* would then allow the automated process of said automated conversion program to continue. Optionally, a key signature transposition routine could be added to the various conversion programs developed from the flowchart of FIG. 31, wherein the entire hexaline note collection displayed and in memory would be displaced the required number of semitones on the hexaline stack image scoring means 270 along with appropriate alterations in the sequential octave-designating noteforms to obtain the desired key signature.

With the described levels of composited convert/-write program formats as would be developed from the algorithm of FIG. 31, the hexaline musical composition being written, when written manually by keyboard or graphics input means F11, is written in essentially the same manner as is currently done with pentaline computer assisted music write programs, that is, with a scrollable music scoring grid system 273 and a suitable two-dimensionally rotatable constantly refreshed graphics menu, as shown in hexaline form in FIG. 32 271. And with said menu being utilized with various graphic input and cursor control devices such as a mouse, data tablet, trackball, joy-stick, touch sensitive overlay panel, light pen, or by keyboard controllers F11, in cooperation with a cathode ray tube or crt F5, or alternately with a Light Emitting Diode of LED video display unit. The manual computer assisted write-out of a hexaline music score is then accomplished by using the appropriate graphic input device F11 and/or cursor control means F11 to select data items from the video display menu 271 for insertion, movement and deletion within the window of the hexaline scoring means 270. The left portion of the graphics menu 271 shows empty and darkened triangular noteheads of two sizes, one for standard-sized notes and one for grace notes, which is followed below by various stem portions, beam portions, and the elongated plus sign and time symbol dot. Also displayed at 271 are darkened oval and empty oval noteforms of two sizes, one for standard-sized notes and one for grace notes, adjacent to which are shown two sets of left-facing octave-designating enclosed flag systems, followed by two sets of right-facing time-related flags, for standard-sized and grace notes respectively.

Each of the hexaline notes to be manually written out on the graphic scoring means 270 is initially assembled on the scoring means by utilizing said control means F11 to select and move (and rotate if necessary) the required note portions to their appropriate position on the stack images 270*a*,270*b*,270*c*, to complete said noteforms as respectively singular composited pitch/time displays musically equivelent to their pentaline counterparts being converted, or as proper musical notes being newly drafted. In a middle vertical column 271*a* in the display menu for FIG. 32, graphic images of modified form hexaline clefs 272 appear which may be similarly selected and moved into proper positioning on the respective stacks adjacent to the written out key signature 272*a* and time signature 272*b*. On the right side of the menu 271 are shown the variou miscelaneous musical notational graphics required to complete the manual write-out of the hexaline composition, such as key signature arrow, bar line, repeat sign, accidental signs, rests, letters, numerals, guitar fingerboard grid, and so forth, with the understanding that ties, slurs and other line graphics required may be drawn in by said graphic input devices F11, with lyrics and other language requirements being either menu-selected and written out, or written out via a keyboard means F11.

When the on-screen hexaline score image 270 is written out fully to the right end of the display, as is presently exemplified by the appearance of transoctave notation in the ovalflagged form across the length of the three stacks 270*a*,270*b*, 270*c*, a scroll control means set forth in the menu or in the graphics input devices F11, allows the three-stack image along with its written out digitized graphics entries to be scrolled to the left into the computer's temporary memory registers or into said external storage means F9, with the inserted key signature 272*a*, and time signature 272*b* and clefs 272 maintained until menu-altered, thence presenting a blank hexaline scoring means on said three stacks to allow any further write-out of the composition to continue until outputted in the previously described manner.

It should be understood from the various preceding descriptions of the graphic score conversion and write-out methods that whichever method is utilized to obtain the minimally required pitch/time values of the pentaline source notes that will permit conversion into graphic hexaline format of write-out, that the essential functional purpose of any alternate electronic conversion or writing means is to expedite and not to alter the basic manual pentaline to hexaline score conversion and write-out process. That is, the alternate electronic means for score conversion and write-out processing as described only serve to duplicate the operative means of the score conversion template and table chart means and template write-out means. Thus while the preceding descriptions of graphic conversion and write-out embodiments contains many specificities, these should not be construed as limitations upon the scope of the invention, but rather as a exemplification of several preferred embodiments thereof. Many other variations are possible, for example, minimal pitch/time values F3 could be obtained electronically by means of an acoustic analyzer such as is used to provide real-time oscilloscopic displays of frequency and duration values for played pentaline music. Such pitch/time values as would be obtained from such a method could be utilized to provide the basis for a hexaline graphic manual computer assisted write method wherein the acoustic analyzer converts absolute pitch in an eight octave compass to provide a "1–97" value for a table search routine F6 which converts said value into an on-screen display F5 of the required noteform outline in the proper stack position as previously described in terms of FIG. 32 274,274*a*, with duration then being encoded as approximated number and symbol values by the processing routine F6 to appear on the display means F5 as a basic "1–7" time state enumeration 274*b* plus a set of appropriate symbols for suggested dots, such as the viewable "D" after the "3" for quarter-note, and such as "T" for tie time values.

In lieu of an acoustic analyzer method or other methods described, minimal "1–97" pitch value enumerations could be derived by utilizing an electric chromatic keyboard (at F11 or F3) such as was described for the electric graphic keyboard of FIGS. 7,11, to route electrically digitally encoded pitch levels from "1–97" into computer program table utility routines F6 which would table search the proper noteform and stack position for successive on-screen displays in the stack window 274 for movement in the previously described manner to the scoring means 270 after user-decisions on appropriate time values to be entered.

At a simpler level of score conversion processing, any chromatic keyboard could have its respective C-octave ranged keys provided with a C through B set of sequential "1–12" semitone enumerations marked in a viewable manner by suitable marking means for the purpose of designating which of the "1–12" numbers are being used and in which octave numbers relative to middle-C as a reference median position to obtain the required hexaline conversion data for the write-out F11 of a pentaline score being played upon said numbered keyboard.

Alternately, the printer means F7 utilized for the production of a hexaline hard copy score F8 from the digitized information provided by the previously described methods could be made to print in the color coding and shading methods of the graphic scoring and referencing inventions of the Graphic Music system, and also be made to print in terms of a linear coded format. And if alternately programmed to do so, could print all such methods in the previously described vertical format for a hexaline score. Accordingly, the scope of the invention of a Graphic Music System as it applies to the graphic score conversion and write-out means embodiments should be determined not by the embodiments illustrated, but by the appended claims and their legal equivelents.

In summation, the integral invention of the Graphic Music System for use in association with the keying means of chromatic musical tone generator means and existing pentaline music means, is a unitive invention comprising in combination: a keying means for use in association with musical tone generators consisting of transversely arrayed, manually depressible, parallel, suitably hinged, essentially coextensive, substantially narrower and substantially wider, alternately arranged keys, acting in lieu of mechanical or electric chromatic keyboards or as a superposable keyboarding means for a chromatic keyboard; and, a cooperative hexaline scoring means for use with the keying means of chromatic musical tone generator means consisting of a perceivably markable medium with suitable perceivable marking means, wherein said markings made on said suitable marking means have one or more sets of six evenly spaced, parallel lines, with five internal spaces and one lower external space which act together as twelve sequentially relative scoring positions for the further marking of absolute pitched octave designating notational means, whereby a multioctaved compass of said pitch notation may be marked upon said twelve relatively scored positions; with, an intercooperative perceivable referencing means for equivelent use in association with said cooperative hexaline scoring means and said keying means of chromatic musical tone generator means, wherein said referencing means has three alternate perceivable markings made by suitable marking means respectively on said hexaline scoring means and on said keying means for said tone generator means or adjacent thereto, provided for the respective end, middle and intermediate subsets of the octavally line-related tone positions, with a fourth alternate marking provided for the respective end and middle octavally space-related tone positions; with, an enumerational means for pentaline line and space related tone positions associated with an enumerational means for hexaline scoring means line and space related positions, whereby hexaline scoring means tone positions may be derived, so that the resultant keying means and playing means for chromatic musical tone generators may be interpreted in terms of a common graphic coding format both for newly written and previously existent music.

The invention of a Graphic Music System thus additionally comprehends any facsimile of a graphically referenced hexaline scoring means or keying means done in the manner of the invention for the purpose of exemplification of the methods or means of musical organization and representation utilized by said invention of a Graphic Music System.

I claim:

1. In a uniform keyboard for use with chromatic tone generator means, of the type having a plurality of transversely arrayed, parallel, manually depressible, alternately arranged upper case and lower case keys, the improvement comprising:

said keys being essentially coextensive, uniformly narrowed upper case keys, and uniformly widened lower case keys, with connective supportively hinging means, and with connective means for connection to said chromatic tone generator means, whereby manual depression of said improved keys with said connective supportively hinging means connective with said chromatic tone generator means will actuate said tone generator means.

2. The uniform keyboard with improved keys according to claim 1, wherein said chromatic tone generator means has a key action assembly, and wherein said improved keys have an extended rear portion, said rear portion being recessed at the immediate rear of said uniformly narrowed upper case keys, and wherein said improved keys have a guide member means, enabling said improved keys to become movably connective with said key action assembly as a connective supportively hinging means, and as a connective means for connection to said chromatic tone generator means.

3. The uniform keyboard with improved keys according to claim 1, wherein said chromatic tone generator means is electrically operative, and wherein said improved keys with connective supportively hinging means have connective electric switching means with electric connectional means with said electrically operative chromatic tone generator means.

4. The uniform keyboard with improved keys according to claim 3, wherein said improved keys are alternately embodied as facsimiles of the top surfaces of said improved keys, presented in a flat plane, marked by marking means upon the top flat surface of a touch sensitive membrane electric switching means, acting as a connective supportively hinging means for said improved key facsimiles, superposably positioned over a plurality of said electric connectional means with said electrically operative chromatic tone generator means.

5. The uniform keyboard with improved keys according to claim 1, for use as an over-keyboard for a standard keyboard as a keying means for said chromatic tone generator means, wherein said improved keys with said connective supportively hinging means are movably contained within a frame means able to be superposably attachably removably connective with said standard keyboard, with the approximate mid-longitudinal portions of said improved keys being respectively aligned above the keying surfaces of said standard keyboard keys, and with downwardly disposed contact member means respectively connective with said improved keys, whereby manual depression of said improved keys with connective supportively hinging means will effectively downwardly displace said contact member means to engage said standard keyboard keys positioned thereunder, depressing said standard keys and actuating said chromatic tone generator means.

6. The uniform keyboard with improved keys according to claim 5, further comprising a transverse frontal frame support member means connective with a downwardly disposed transverse support means, for attachable removably connective support of said frame means upon the frontal transverse support member of said standard keyboard.

7. The uniform keyboard with improved keys according to claim 5, wherein mechanical advantage is obtained for said improved keys with connective supportively hinging means, by further additon of a separate second set of downwardly disposed contact member means appropriately aligned beneath said first set of downwardly disposed contact member means, with a second set of movably connective supportively hinging means for said second set of contact member means, whereby manual depression of said improved keys with said first set of connective supportively hinging means and said first set of contact member means depresses said second set of contact member means with said second set of movably connective supportively hinging means to slidably engage and depress said standard keyboard keys positioned thereunder, thence actuating said chromatic tone generator means.

8. The uniform keyboard with improved keys according to claim 7, further comprising a transverse frontal frame support member means connective with a downwardly disposed transverse support means, for attachably removably connective support of said frame means upon the frontal transverse support member of said standard keyboard.

9. A score conversion means for converting pentaline scored music pitch positions and noteforms into mathematically equivalent hexaline scored music pitch positions and octave range designating absolute pitch noteforms for use with hexaline scoring means of the type having a markable display means with marking means, with first perceivable markings marked upon said markable display means by said marking means, comprising a minimum of one set of six evenly spaced parallel lines with five internal spaces and one external space for further use as a markable display means for twelve relative octave tone positions, with second perceivable markings marked by said marking means upon said markable display means for twelve relative octave tone positions, consisting of a plurality of sequential octave range designating absolute pitch notational symbol means, said score conversion means comprising:

a means to measure and specify pentaline line and space related music pitch positions; and an associated means to measure and specify hexaline line and space related music pitch positions and octave range designating absolute pitch noteforms on said hexaline scoring means, mathematically equivalent to said pentaline line and space related music pitch positions, whereby said mathematically equivalent hexaline pitch positions and noteforms may be derived from said pentaline pitch positions for use with said hexaline scoring means.

10. A score conversion means according to claim 9, wherein said markable display means with marking means further comprises an electrovisual display means with electronic marking means.

11. A score conversion means according to claim 9, wherein said associated means to measure and specify hexaline line and space related music pitch positions and octave range designating absolute pitch noteforms, is an associated electronic means of measuration and specification.

12. A score conversion means according to claim 11, wherein said markable display means with marking means further comprises an electrovisual display means with electronic marking means.

* * * * *

UNITED STATES PATENT AND TRADEMARK OFFICE

CERTIFICATE OF CORRECTION

PATENT NO. : 4,885,969

DATED : December 12, 1989

INVENTOR(S) : Thomas P. Chesters

It is certified that error appears in the above-identified patent and that said Letters Patent is hereby corrected as shown below:

Column 10, line 42, after "design" insert - ,i.e., as a facsimile of the top surfaces of said keys, -.
Column 10, line 63, change "connector port" to - input/output multiconnection interface connector -.
Column 10, line 66, after "10" insert - 136 -.
Column 13, line 30, after "by" insert - contact member -.
Column 13, line 33, after "full length" insert - contact member -.
Column 13, line 33, before "slot 169" insert - accommodation -.
Column 14, line 19, after "arms" insert - 161 -.
Column 14, line 24, after "screws" insert - (not shown) -.
Column 14, line 32, after "member" insert - 156 -.
Column 38, line 29, change "272" to - 188, 189 -.
Column 40, line 56, delete "essentially."
Column 41, line 18, change "facsimiles" to - replicas -.
Column 41, line 23, change "facsimiles" to - replicas -.

UNITED STATES PATENT AND TRADEMARK OFFICE

CERTIFICATE OF CORRECTION

PATENT NO. : 4,885,969

DATED : December 12, 1989

INVENTOR(S) : Thomas P. Chesters

It is certified that error appears in the above-identified patent and that said Letters Patent is hereby corrected as shown below:

Column 41, line 33, delete "approximate."

Signed and Sealed this

Thirtieth Day of October, 1990

*Attest:*

*Attesting Officer*

HARRY F. MANBECK, JR.

*Commissioner of Patents and Trademarks*